US010007206B2

(12) United States Patent
Sugahara et al.

(10) Patent No.: US 10,007,206 B2
(45) Date of Patent: Jun. 26, 2018

(54) MAGNETIC CARRIER, TWO-COMPONENT DEVELOPER, REPLENISHING DEVELOPER, AND IMAGE-FORMING METHOD

(71) Applicant: CANON KABUSHIKI KAISHA, Tokyo (JP)

(72) Inventors: Nobuyoshi Sugahara, Tokyo (JP); Hironori Minagawa, Moriya (JP); Wakashi Iida, Toride (JP); Atsushi Nakano, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/426,628

(22) Filed: Feb. 7, 2017

(65) Prior Publication Data

US 2017/0227866 A1 Aug. 10, 2017

(30) Foreign Application Priority Data

Feb. 8, 2016 (JP) ..... 2016-022014

(51) Int. Cl.
*G03G 9/107* (2006.01)
*G03G 9/113* (2006.01)
*G03G 15/08* (2006.01)

(52) U.S. Cl.
CPC ..... *G03G 9/1133* (2013.01); *G03G 9/1075* (2013.01); *G03G 15/0887* (2013.01)

(58) Field of Classification Search
CPC .. G03G 9/1131; G03G 9/1133; G03G 9/1138; G03G 9/113; G03G 9/1075; G03G 9/107
USPC ..... 430/111.32, 111.35
See application file for complete search history.

(56) References Cited

U.S. PATENT DOCUMENTS

| | | | | |
|---|---|---|---|---|
| 5,437,949 | A | 8/1995 | Kanbayashi et al. | |
| 5,607,806 | A | 3/1997 | Kanbayashi et al. | |
| 5,635,326 | A | 6/1997 | Kanbayashi et al. | |
| 5,670,288 | A | 9/1997 | Okado et al. | |
| 5,700,617 | A | 12/1997 | Takiguchi et al. | |
| 5,747,209 | A | 5/1998 | Takiguchi et al. | |
| 5,851,714 | A | 12/1998 | Taya et al. | |
| 5,912,099 | A | 6/1999 | Kanbayashi et al. | |
| 5,922,500 | A | 7/1999 | Iida et al. | |
| 5,994,018 | A | 11/1999 | Iida et al. | |
| 6,013,402 | A | 1/2000 | Kanbayashi et al. | |
| 6,022,659 | A | 2/2000 | Kanbayashi et al. | |
| 6,077,635 | A | 6/2000 | Okado et al. | |
| 6,326,114 | B1 | 12/2001 | Itakara et al. | |
| 6,528,222 | B2 | 3/2003 | Kohtaki et al. | |
| 6,586,147 | B2 | 7/2003 | Iida et al. | |
| 6,664,016 | B2 | 12/2003 | Kanbayashi et al. | |
| 6,723,822 | B2 * | 4/2004 | Shirai | C08G 63/195 525/444 |
| 6,751,424 | B2 | 6/2004 | Komatsu et al. | |
| 6,808,852 | B2 | 10/2004 | Hotta et al. | |
| 6,929,894 | B2 | 8/2005 | Sugahara et al. | |
| 7,115,349 | B2 | 10/2006 | Iida et al. | |
| 7,138,213 | B2 | 11/2006 | Itakara et al. | |
| 7,144,668 | B2 | 12/2006 | Baba et al. | |
| 7,147,980 | B2 | 12/2006 | Itakura et al. | |
| 7,279,262 | B2 | 10/2007 | Fujikawa et al. | |
| 7,288,348 | B2 | 10/2007 | Hayami et al. | |
| 7,297,455 | B2 | 11/2007 | Fujikawa et al. | |
| 7,300,733 | B2 | 11/2007 | Sugahara et al. | |
| 7,396,626 | B2 | 7/2008 | Fujikawa et al. | |
| 7,396,629 | B2 | 7/2008 | Baba et al. | |
| 7,442,478 | B2 | 10/2008 | Itakura et al. | |
| 7,455,947 | B2 | 11/2008 | Ida et al. | |
| 7,536,132 | B2 | 5/2009 | Minagawa | |
| 7,816,063 | B2 | 10/2010 | Hashimoto et al. | |
| 8,945,805 | B2 | 2/2015 | Baba et al. | |
| 9,075,328 | B2 | 7/2015 | Minagawa et al. | |
| 9,158,217 | B2 | 10/2015 | Takahashi et al. | |
| 9,372,420 | B2 | 6/2016 | Mizo et al. | |
| 9,454,094 | B2 | 9/2016 | Tsujimoto et al. | |
| 9,500,975 | B2 | 11/2016 | Sugahara et al. | |
| 9,599,920 | B2 | 3/2017 | Sugahara et al. | |

(Continued)

FOREIGN PATENT DOCUMENTS

| | | | |
|---|---|---|---|
| EP | 2829920 | A1 * | 1/2015 |
| JP | H05-072815 | A | 3/1993 |
| JP | 2000-039740 | A | 2/2000 |
| JP | 2000-314990 | A | 11/2000 |
| JP | 2001-075315 | A | 3/2001 |
| JP | 2001-343790 | A | 12/2001 |
| JP | 2002-091090 | A | 3/2002 |
| JP | 2008-181162 | A | 8/2008 |
| JP | 2009-139707 | A | 6/2009 |
| JP | 2009-237525 | A | 10/2009 |
| JP | 2011-112839 | A | 6/2011 |
| JP | 2011-158831 | A * | 8/2011 |
| JP | 2013-231766 | A | 11/2013 |

OTHER PUBLICATIONS

Japanese Patent Office J-Plat-Pat machine-assisted English-language translation of JP 2011-158831 A (pub. Aug. 2011). (Year: 2011).*

U.S. Appl. No. 15/241,317, Nobuyoshi Sugahara, filed Aug. 19, 2016.

*Primary Examiner* — Janis L Dote
(74) *Attorney, Agent, or Firm* — Fitzpatrick Cella Harper and Scinto

(57) ABSTRACT

A magnetic carrier having a ferrite-type core material and a resin coat layer present on the surface of the ferrite-type core material, wherein the ferrite-type core material contains a magnetic ferrite-type core material particle and an amino group-bearing primer compound; the resin coat layer contains a coating resin A that is a polymer of monomer containing a (meth)acrylate ester having an alicyclic hydrocarbon group; the content of the amino group-bearing primer compound in the ferrite-type core material and the content of the resin coat layer in the magnetic carrier are within the prescribed range.

11 Claims, 5 Drawing Sheets

(56) References Cited

U.S. PATENT DOCUMENTS

| | | | | |
|---|---|---|---|---|
| 2010/0273103 | A1* | 10/2010 | Baba ..... | G03G 9/0819<br>430/110.4 |
| 2014/0096409 | A1 | 4/2014 | Ohtsu et al. | |
| 2014/0101966 | A1 | 4/2014 | Minagawa et al. | |
| 2014/0137428 | A1 | 5/2014 | Takenaka et al. | |
| 2015/0017581 | A1 | 1/2015 | Tsuchida et al. | |
| 2015/0268577 | A1 | 9/2015 | Takahashi et al. | |
| 2016/0306301 | A1 | 10/2016 | Sugahara et al. | |
| 2016/0363889 | A1 | 12/2016 | Onozaki et al. | |

* cited by examiner

MAGNETIC CARRIER, TWO-COMPONENT DEVELOPER, REPLENISHING DEVELOPER, AND IMAGE-FORMING METHOD

FIELD OF THE INVENTION

The present invention relates to a magnetic carrier for use in a two-component developer for developing (visualizing) an electrostatic latent image (electrostatic charge image) by electrophotography, and to a two-component developer that contains this magnetic carrier.

DESCRIPTION OF THE RELATED ART

Electrophotography has in recent years been widely used in, for example, copiers and printers, and must be able to respond to a variety of objects, such as fine lines, small characters, photographs, and color originals. In addition, higher image qualities, higher definitions, higher speeds, and continuous execution are also being required, and it is thought that these demands will continue to increase in the future.

A lightweight composite particle with a specific gravity of about 2.0 to 5.0 that does not fracture the toner even with higher speeds and continuous execution is broadly used as a carrier particle that satisfies these demands.

The demand for improvements in the properties of the carrier particle has not come to a stop, and in particular an excellent charging performance as a magnetic carrier for small particle diameter toner is required in order to achieve higher image qualities for full color images.

That is, it is crucial that a uniform amount of charge be imparted to the toner, that the amount of charge not vary even during long-term use, and that the amount of charge not vary regardless of changes in the environment. There is strong demand that a magnetic carrier that satisfies these properties also exhibit an excellent durability.

In order to bring about improvements in magnetic carrier durability, (1) magnetic carriers have been provided by treating the magnetic core particle surface with an aminosilane coupling agent and additionally coating it with a resin (refer to Japanese Patent Application Laid-open Nos. 2008-181162, 2000-314990, 2000-039740, H5-072815, and 2002-091090).

However, magnetic carriers that exhibit an excellent durability are at the present time in greatest demand and there is desire for additional improvements in the durability.

In addition, in order to form a lightweight composite particle, the magnetic carrier core particle is generally constructed from a magnetic body component and a resin component. The environmental influence on the charge is one concern caused by the use of resin components that are easy to produce and/or are inexpensive.

Within this context, there are examples in which the amount of moisture absorption by the magnetic carrier particle is controlled (refer to Japanese Patent Application Laid-open Nos. 2009-139707, 2001-075315, and 2001-343790). While the amount of moisture absorption by the magnetic carrier particle can be restrained by doing this, additional improvements are required.

SUMMARY OF THE INVENTION

The present invention provides a magnetic carrier that resists the appearance of image density differences in each of the following environments: high-temperature, high-humidity environments, normal-temperature, low-humidity environments, and normal-temperature, normal-humidity environments, and with which there is little change in image density pre-versus-post-standing in a high-temperature, high-humidity environment.

The present invention also provides a two-component developer that contains this magnetic carrier and a replenishing developer that contains this magnetic carrier.

The present invention also provides an image-forming method that uses this two-component developer or replenishing developer.

(1) The present invention is a magnetic carrier having a magnetic carrier particle that has a magnetic ferrite-type core material particle, an intermediate layer on the ferrite-type core material particle, and a resin coat layer on the intermediate layer, wherein the intermediate layer contains an amino group-bearing compound;

the resin coat layer contains a coating resin A that is a polymer of monomer that contains a (meth)acrylate ester having an alicyclic hydrocarbon group;

the content of the amino group-bearing compound in the intermediate layer is at least 0.010 mass parts and not more than 0.090 mass parts per 100 mass parts of the ferrite-type core material particle; and the content of the resin coat layer in the magnetic carrier particle is at least 0.5 mass parts and not more than 5.0 mass parts per 100 mass parts of the total mass of the ferrite-type core material particle and the intermediate layer.

(2) The present invention is a two-component developer that contains the aforementioned magnetic carrier and a toner.

(3) The present invention is a replenishing developer that contains the aforementioned magnetic carrier and a toner.

(4) The present invention is an image-forming method that uses the aforementioned two-component developer or replenishing developer.

The present invention can provide a magnetic carrier that resists the appearance of image density differences in each of the following environments: high-temperature, high-humidity environments, normal-temperature, low-humidity environments, and normal-temperature, normal-humidity environments, and with which there is little change in image density pre-versus-post-standing in a high-temperature, high-humidity environment.

Further features of the present invention will become apparent from the following description of exemplary embodiments with reference to the attached drawings.

DESCRIPTION OF THE EMBODIMENTS

Figure 1:
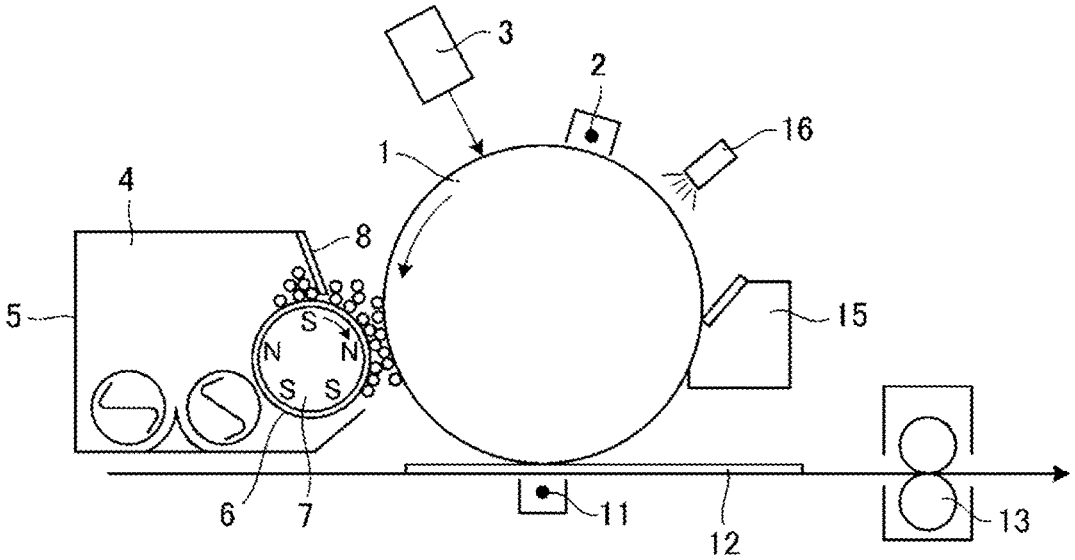
FIG. 1 is a schematic diagram of an image-forming apparatus.

Unless specifically indicated otherwise, the phrases "at least XX and not more than YY" and "XX to YY" that indicate numerical value ranges mean that the numerical value ranges include the lower limit and upper limit that are the end points.

The magnetic carrier of the present invention is a magnetic carrier having a magnetic carrier particle that has a ferrite-type core material particle, an intermediate layer on the ferrite-type core material particle, and a resin coat layer on the intermediate layer, wherein the intermediate layer contains an amino group-bearing compound; the resin coat layer contains a coating resin A that is a polymer of monomer that contains a (meth)acrylate ester having an alicyclic hydrocarbon group; the content of the amino group-bearing compound in the intermediate layer is at least 0.010 mass parts and not more than 0.090 mass parts per 100 mass parts of the ferrite-type core material particle; and the content of the resin coat layer in the magnetic carrier particle is at least 0.5 mass parts and not more than 5.0 mass parts per 100 mass parts of the total mass of the ferrite-type core material particle and the intermediate layer.

The combination of the ferrite-type core material particle and the intermediate layer is also referred to in the following as the "ferrite-type core material". The amino group-bearing compound is also referred to as the "amino group-bearing primer compound" or the "primer compound".

The role of the amino group-bearing primer compound is to increase the adhesiveness between the ferrite-type core material and the resin coat layer, but it is known that amino group-bearing primer compounds also have the effect of improving the chargeability of magnetic carriers. Due to this, there are also examples of the chargeability being adjusted by their addition in particular to low-chargeability fluorine-containing acrylic resins and silicone resins used as coating resins.

However, while the chargeability in a normal-temperature, low-humidity environment is improved, an improved chargeability in high-temperature, high-humidity environments is not seen, and the problem has arisen of an increase in the difference in image density brought about by differences in the environment.

In addition, in the case of fluorine-containing acrylic resins and silicone resins, the hoped for chargeability-improving effect has not been obtained even when used as a primer layer (intermediate layer) with the ferrite-type core material.

The role of the resin coat layer, on the other hand, is to bring about a long-term and stable charging of the toner. It is critical for this that the coating resin have a high coating film strength and that the surface of the coating resin not undergo deterioration due to stresses such as friction. In the prior art, fluorine-containing acrylic resins and silicone resins are used to obtain these effects.

However, when a copier continues to be used under severe use conditions, e.g., in the presence of environmental variations or with continuous output, chipping and peeling of the coating resin have been produced and have interfered with image quality. This has occurred because fluorine-containing acrylic resins and silicone resins are hard and brittle substances.

In view of these circumstances, there are examples of the use of acrylic resins and polyester resins as the coating resin. These are not as hard and not as brittle as fluorine-containing acrylic resins and silicone resins and resist the occurrence of resin chipping and peeling and are characterized by ease of coating of the ferrite-type core material.

Based on these results, the present inventors achieved the present invention by carrying out intensive investigations into the design of a carrier that could exhibit all of the following effects: the adhesiveness and chargeability-improving effects provided by amino group-bearing primer compounds and the image stability provided by acrylic coating resins.

The magnetic carrier of the present invention is a magnetic carrier that has a ferrite-type core material and a resin coat layer present on the surface of this ferrite-type core material wherein this ferrite-type core material contains a magnetic ferrite-type core material particle and an amino group-bearing primer compound.

In addition, the resin coat layer contains a coating resin that is a polymer of monomer that contains at least a (meth)acrylate ester having an alicyclic hydrocarbon group.

By adopting this constitution, the magnetic carrier of the present invention was able to bring about an increase in the chargeability in high-temperature, high-humidity environments without increasing the chargeability in normal-temperature, low-humidity environments more than necessary.

The hypothesis here is that a portion of the amino groups in the primer compound is converted to the ammonium ion by the moisture in a high-humidity environment, which brings about an increase in the positive chargeability of the magnetic carrier.

In a low-humidity environment, on the other hand, conversion of the amino group to the ammonium ion is impeded and the chargeability is not increased more than necessary.

The characteristics of the coating resin are crucial for causing this effect to appear.

As a result of intensive investigations, the present inventors discovered that a polymer of monomer containing a (meth)acrylate ester having an alicyclic hydrocarbon group is a coating resin that exhibits the aforementioned effect to the maximum degree. Here, (meth)acrylate ester denotes an acrylate ester or a methacrylate ester.

While the details here are not clear, the present inventors believe as follows. A (meth)acrylate ester having an alicyclic hydrocarbon group has a lower polarity and a higher water repellency than ordinary (meth)acrylate esters. Therefore, when the coating resin according to the present invention is coated on a ferrite-type core material bearing the primer compound, the moiety corresponding to the low-polarity (meth)acrylate ester having an alicyclic hydrocarbon group readily undergoes orientation at the surface layer of the magnetic carrier.

As a result, it is thought that the entrance and exit of moisture at the carrier surface layer is reduced and, with regard to moisture at the carrier surface layer that has been incorporated to the interior side of the alicyclic hydrocarbon group, its release from the carrier is then suppressed and due to this an increase in the positive chargeability under high humidities is brought about through the effect of the amino group of the primer compound.

On the other hand, it is thought that, since the alicyclic hydrocarbon group in the carrier surface layer causes a reduction in the entrance and exit of atmospheric moisture, humidity-induced charge relaxation is reduced and the change in image density pre-versus-post-standing in a high-temperature, high-humidity environment can then be reduced.

With regard to actual confirmation, the effects of the present invention were not obtained with fluorine-containing acrylic resins and silicone resins because moisture passage did not occur and were not obtained with acrylic resins lacking an alicyclic hydrocarbon group and polyester resins due to an excessive moisture entrance/exit.

The resin coat layer in the present invention contains a coating resin A that is a polymer of monomer that at least contains a (meth)acrylate ester having an alicyclic hydrocarbon group.

This polymer of monomer that at least contains a (meth) acrylate ester having an alicyclic hydrocarbon group (i.e., coating resin A) smoothes out the coating film surface of the resin layer coated on the surface of the ferrite-type core material. It can as a result function to inhibit the attachment of toner-derived components to the magnetic carrier and suppress reductions in the chargeability.

The present invention also accrues the effect of reducing the moisture adsorption/desorption frequency and thus makes possible an enhancement in the characteristic charge-imparting effect of the primer compound in high-humidity environments. The chargeability relaxation brought about by standing can also be reduced and image density differences pre-versus-post-standing in a high-temperature, high-humidity environment can be reduced.

Moreover, when the resin coat layer does not contain this coating resin A, deterioration of the resin coat layer then occurs and the halftone density reproducibility declines.

The alicyclic hydrocarbon group-bearing (meth)acrylate ester (monomer) can be exemplified by cyclobutyl acrylate, cyclopentyl acrylate, cyclohexyl acrylate, cycloheptyl acrylate, dicyclopentenyl acrylate, dicyclopentanyl acrylate, cyclobutyl methacrylate, cyclopentyl methacrylate, cyclohexyl methacrylate, cycloheptyl methacrylate, dicyclopentenyl methacrylate, and dicyclopentanyl methacrylate. A single selection from these may be used or two or more selections may be used.

The coating resin A may be a copolymer provided by using as monomer the aforementioned alicyclic hydrocarbon group-bearing (meth)acrylate ester and another (meth) acrylic monomer.

This additional (meth)acrylic monomer can be exemplified by methyl acrylate, methyl methacrylate, ethyl acrylate, ethyl methacrylate, butyl (n-butyl, sec-butyl, isobutyl, or tert-butyl; this also applies in the following) acrylate, butyl methacrylate, 2-ethylhexyl acrylate, 2-ethylhexyl methacrylate, acrylic acid, and methacrylic acid.

Viewed from the standpoint of facilitating synergy with the primer compound according to the present invention, the alicyclic hydrocarbon group-bearing (meth)acrylate ester (monomer) is preferably incorporated at at least 50.0 mass parts and not more than 95.0 mass parts (more preferably at least 50.0 mass parts and not more than 90.0 mass parts) where the total monomer for the coating resin A is 100 mass parts.

Viewed from the standpoint of the stability of the coating, the weight-average molecular weight (Mw) of the coating resin A used in the present invention is preferably at least 20,000 and not more than 120,000 and is more preferably at least 30,000 and not more than 100,000.

The content of the amino group-bearing primer compound, per 100 mass parts of the magnetic ferrite-type core material particle, is at least 0.010 mass parts and not more than 0.090 mass parts and preferably at least 0.010 mass parts and not more than 0.080 mass parts. At least 0.010 mass parts and not more than 0.060 mass parts or at least 0.020 mass parts and not more than 0.080 mass parts is more preferred.

Control of the chargeability is impaired when the amount of the primer compound is too large or too small. Accordingly, the amount of the primer compound must be an appropriate amount for reducing the image density differences caused by different environments and reducing the image density differences pre-versus-post-standing in a high-temperature, high-humidity environment.

The amino group-bearing primer compound can be specifically exemplified by 3-aminopropyltrimethoxysilane, 3-aminopropyltriethoxysilane, 3-aminopropyldiethoxymethylsilane, 3-(2-aminoethylamino)propyltrimethoxysilane, 3-(2-aminoethylamino) propyltriethoxysilane, 3-(2-aminoethylamino) propyldimethoxymethylsilane, 3-aminopropyldimethoxymethylsilane, 3-aminopropyltriethoxysilane, trimethoxy[3-(phenylamino)propyl]silane, trimethoxy[3-(methylamino)propyl]silane, [3-(N,N-dimethylamino)propyl]trimethoxysilane, N-phenyl-3-aminopropyltrimethoxysilane, N-2-(aminoethyl)-3-aminopropylmethyldimethoxysilane, N-2-(aminoethyl)-3-aminopropyltrimethoxysilane, and N-2-(aminoethyl)-3-aminopropyltriethoxysilane.

The primer compound preferably reacts with and is thereby immobilized to the surface of the ferrite-type core material particle surface. This makes it possible to obtain a magnetic carrier with greater long-term stability.

The method for reacting and immobilizing the primer compound to the surface part of the ferrite-type core material particle can be exemplified by stirring the ferrite-type core material particle with the primer compound while heating.

The execution of immobilization by reacting the aforementioned primer compound with the hydroxy groups on magnetic ferrite-type core material particles is generally known. There are numerous examples to date of the use of the aforementioned compounds as primers. However, in many cases they are used in excess, and, while there is a high effect as a primer, it has been difficult to bring about an increase in the chargeability for only high-temperature, high-humidity environments and/or to maintain the chargeability pre-versus-post-standing in a high-temperature, high-humidity environment.

The content of the resin coat layer in the magnetic carrier in the present invention, per 100 mass parts of the ferrite-type core material, is at least 0.5 mass parts and not more than 5.0 mass parts and is preferably at least 1.0 mass parts and not more than 4.5 mass parts.

Control of the chargeability is impaired when the content of the resin coat layer is too large or too small, which must thus be an appropriate amount for reducing the image density differences caused by different environments and reducing the image density differences pre-versus-post-standing in a high-temperature, high-humidity environment.

The coating resin A used in the resin coat layer is preferably a copolymer of monomer that includes a macromonomer and the (meth)acrylate ester having an alicyclic hydrocarbon group.

Compared to the case in which a macromonomer is not used in the resin coat layer, there is a greater effect with regard to reducing the image density differences caused by different environments and reducing the image density differences pre-versus-post-standing in a high-temperature, high-humidity environment; the stability of the image density is also further improved.

The monomer that can produce this macromonomer can be the monomer indicated above for the additional (meth) acrylic monomer and also styrene, acrylonitrile, and methacrylonitrile.

The macromonomer is preferably a polymer from one monomer or two or more monomers selected from the group consisting of methyl acrylate, methyl methacrylate, butyl (n-butyl, sec-butyl, isobutyl, or tert-butyl) acrylate, butyl (n-butyl, sec-butyl, isobutyl, or tert-butyl) methacrylate, 2-ethylhexyl acrylate, 2-ethylhexyl methacrylate, styrene, acrylonitrile, and methacrylonitrile.

The weight-average molecular weight (Mw) of the macromonomer is preferably at least 2,000 and not more than 10,000 and is more preferably at least 3,000 and not more than 8,000.

The macromonomer content, using 100 mass parts for the total monomer for coating resin A, is preferably at least 5.0 mass parts and less than 50.0 mass parts and is more preferably at least 5.0 mass parts and not more than 40.0 mass parts.

The resin coat layer is described below for the use of a composition of two or more resins.

The present invention can also use a blend of i) a (co)polymer (coating resin A) of monomer containing an alicyclic hydrocarbon group-bearing (meth)acrylate ester (monomer) and optionally macromonomer and additional (meth)acrylic monomer and ii) a coating resin B having a prescribed acid value. The coating resin B is preferably a polymer of monomer that contains at least the previously described additional (meth)acrylic monomer.

By implementing the preceding, the coating film strength of the resin coat layer is enhanced and a stable image can be output over a longer period of time; the ability to accommodate different environments is also enhanced.

When the coating resin A and coating resin B are used for the resin coat layer, their mass ratio (A:B) is preferably 9:1 to 1:9.

When the coating resin A is a polymer of monomer containing at least a (meth)acrylate.ester having an alicyclic hydrocarbon group or is a copolymer of monomer that contains a macromonomer and a (meth)acrylate ester having an alicyclic hydrocarbon group, the acid value of this coating resin A is preferably at least 0.0 mg KOH/g and not more than 3.0 mg KOH/g and is more preferably at least 0.0 mg KOH/g and not more than 2.5 mg KOH/g.

When a polymer of monomer containing at least the previously described additional (meth)acrylic monomer is used for the coating resin B, the acid value of this coating resin B is preferably at least 3.5 mg KOH/g and not more than 50.0 mg KOH/g, more preferably at least 4.0 mg KOH/g and not more than 50.0 mg KOH/g, and even more preferably at least 4.5 mg KOH/g and not more than 40.0 mg KOH/g.

When two or more coating resins are used for the resin coat layer, the effect of reducing the image density differences caused by different environments is enhanced by having the acid value be in the indicated range and the effect of reducing the image density differences pre-versus-post-standing in a high-temperature, high-humidity environment is enhanced by having the acid value be in the indicated range. The acid value of the resin can be controlled by the monomer used.

Viewed from the standpoint of the stability of the coating, the weight-average molecular weight (Mw) of the coating resin B is preferably at least 30,000 and not more than 120,000 and is more preferably at least 40,000 and not more than 100,000.

The minimum film thickness of the resin coat layer in the present invention is preferably at least 0.010 μm and not more than 4.000 μm and more preferably at least 0.050 μm and not more than 3.500 μm.

By having the minimum film thickness of the resin coat layer be in the indicated range, the chargeability-imparting effect of the primer compound can then be easily controlled; reducing the image density differences caused by different environments is facilitated; and reducing the image density differences pre-versus-post-standing in a high-temperature, high-humidity environment is facilitated. The minimum film thickness of the resin coat layer can be controlled through the amount of the coating resin.

In order to obtain the effects of the present invention to an even more significant degree, the resin coat layer in the present invention preferably does not contain an amino group-bearing primer compound. However, a small amount may be incorporated when adjustment of the chargeability is required. The content of this primer compound in the resin coat layer is preferably at least 0.0 mass % and not more than 4.0 mass % and is more preferably at least 0.0 mass % and not more than 3.0 mass %.

The magnetic ferrite-type core material particle is described in the following.

The magnetic ferrite-type core material particle can be exemplified by magnetite and ferrite, but magnetite is a preferred example.

Viewed from the standpoint of enabling a reduction in the specific gravity of the magnetic carrier and bringing about an improvement in the long-term stability of the image, the ferrite-type core material particle is preferably a porous particle having pores and is preferably a particle having a resin filled into these pores.

Ferrite is a sintered compact given by the following general formula.

$$(M1_2O)_x(M2O)_y(Fe_2O_3)_z$$

(In the formula, M1 is a monovalent metal; M2 is a divalent metal; and, for $x+y+z=1.0$, x and y are each $0 \leq (x, y) \leq 0.8$ and z is $0.2<z<1.0$.)

The use of at least one species of metal atom selected from the group consisting of Li, Fe, Mn, Mg, Sr, Cu, Zn, and Ca for the M1 and M2 in the preceding formula is preferred. The following can also be used in addition to the preceding: Ni, Co, Ba, Y, V, Bi, In, Ta, Zr, B, Mo, Na, Sn, Ti, Cr, Al, Si, and the rare earths.

A process for producing the ferrite-type core material particle is described in detail in the following, but there is no limitation to this.

<Step 1 (Weighing and Mixing Step)>

The starting materials for the ferrite under consideration are weighed out and mixed.

The starting materials for the ferrite can be exemplified by, for example, metal particles of the aforementioned metal elements as well as the oxides, hydroxides, oxalates, and carbonates thereof.

The apparatus for pulverizing and mixing these ferrite starting materials can be exemplified by the following: ball mills, planetary mills, jet mills, and vibrating mills. Ball mills are particularly preferred in terms of mixing performance.

Specifically, the weighed-out ferrite starting materials and the balls are introduced into a ball mill and pulverization and mixing are performed for at least 0.1 hours and not more than 20.0 hours.

<Step 2 (Presintering Step)>

The pulverized and mixed ferrite starting materials are presintered in air or under a nitrogen atmosphere for at least 0.5 hours and not more than 5.0 hours in a sintering temperature range of at least 700° C. and not more than 1200° C. in order to carry out ferritization.

For example, an oven or furnace as follows is used for the sintering: a burner-type sintering furnace, a rotary sintering furnace, or an electric furnace.

<Step 3 (Pulverization Step)>

The presintered ferrite produced in step 2 is pulverized using a pulverizer to obtain a pulverized presintered ferrite product.

There are no particular limitations on the pulverizer as long as the desired particle diameter and particle diameter distribution can be obtained.

This pulverizer can be exemplified by the following: crushers, hammer mills, ball mills, bead mills, planetary mills, and jet mills.

The pulverized presintered ferrite product is preferably brought to the desired particle diameter, for example, by controlling the material and diameter of the balls or beads used in a ball mill or bead mill and by controlling the operating time. In specific terms, in order to reduce the particle diameter of the pulverized presintered ferrite product, balls with a heavy specific gravity can be used and the pulverizing time can be lengthened. In order to broaden the particle diameter distribution of the pulverized presintered ferrite product, this can be achieved by using balls or beads with a heavy specific gravity and shortening the pulverizing time. A pulverized presintered ferrite product with a broad distribution can also be obtained by mixing a plurality of pulverized presintered ferrite products that have different particle diameters.

In addition, in comparison to dry methods, the use of wet methods in a ball mill or bead mill provides a higher pulverization efficiency without upward flight of the pulverization product in the mill, and for this reason wet methods are more preferred than dry methods.

<Step 4 (Granulating Step)>

Water, a binder, and optionally a pore modifier are preferably added to the obtained pulverized presintered ferrite product.

The pore modifier can be exemplified by blowing agents and resin fine particles. The blowing agent can be exemplified by sodium bicarbonate, potassium bicarbonate, lithium bicarbonate, ammonium bicarbonate, sodium carbonate, potassium carbonate, lithium carbonate, and ammonium carbonate. The resin fine particles can be exemplified by fine particles of the following: polyesters; polystyrenes; styrene copolymers such as styrene-vinyltoluene copolymer, styrene-vinylnaphthalene copolymer, styrene-acrylate ester copolymer, styrene-methacrylate ester copolymer, styrene-methyl α-chloromethacrylate copolymer, styrene-acrylonitrile copolymer, styrene-vinyl methyl ketone copolymer, styrene-butadiene copolymer, styrene-isoprene copolymer, and styrene-acrylonitrile-indene copolymer; polyvinyl chloride; phenolic resins; modified phenolic resins; maleic resins; acrylic resins; methacrylic resins; polyvinyl acetate; silicone resins; polyester resins that have as a constituent unit monomer selected from aliphatic polyhydric alcohols, aliphatic dicarboxylic acids, aromatic dicarboxylic acids, aromatic dialcohols, and diphenols; polyurethane resins; polyamide resins; polyvinyl butyral; terpene resins; coumarone-indene resins; petroleum resins; and hybrid resins having a polyester unit and a vinyl polymer unit.

For example, polyvinyl alcohol may be used as the binder.

When pulverization has been carried out in step 3 using a wet method, addition of the binder and optional pore modifier is preferably performed also taking into consideration the water present in the slurry of the pulverized presintered ferrite product (ferrite slurry).

The obtained ferrite slurry is dried and granulated using an atomizing dryer in a heated atmosphere having a temperature of at least 100° C. and not more than 200° C.

There is no particular limitation on the atomizing dryer as long as the desired particle diameter is obtained for the ferrite-type core material particle. For example, a spray dryer can be used.

<Step 5 (Main Sintering Step)>

The obtained granulate is then preferably sintered for at least 1 hour and not more than 24 hours at a temperature of at least 800° C. and not more than 1500° C.

Raising the sintering temperature and lengthening the sintering time cause sintering of the ferrite-type core material particle to advance and as a result cause the pore diameter to become smaller and also cause a reduction in the number of pores. A pore-free ferrite-type core material can also be produced by raising the sintering temperature and lengthening the sintering time. In addition, the resistance of the ferrite-type core material particle can be controlled into a preferred range by controlling the sintering atmosphere. The resistivity of the ferrite-type core material particle at 300 V/cm can be brought into the desired range (preferably $1.0\times10^6$ Ω·cm to $1.0\times10^9$ Ω·cm) by having the oxygen concentration be preferably not more than 0.1 volume % and more preferably not more than 0.01 volume % and by also setting up a reducing atmosphere (presence of hydrogen).

<Step 6 (Classification Step)>

After the particles sintered as described above have been ground, as necessary the coarse particles and/or fines may be removed by classification or sieving on a sieve.

The ferrite-type core material particle preferably has a 50% particle diameter (D50) on a volume distribution basis of at least 18.0 m and not more than 68.0 μm from the standpoint of carrier attachment to the image and a high image quality.

<Step 7 (Filling Step)>

The ferrite-type core material particle in the present invention preferably is a particle in which resin has been filled into at least a portion of the pores of the ferrite-type core material particle.

Depending on the interior pore volume, ferrite-type core material particles may exhibit a reduced physical strength, and, in order to raise the physical strength in the role as a magnetic carrier, a resin is preferably filled into at least a portion of the pores of the ferrite-type core material particle.

The amount of resin filled into the pores of the ferrite-type core material particle is preferably at least 2 mass parts and not more than 15 mass parts per 100 mass parts of the ferrite-type core material particle.

As long as there is little variation in the resin content from magnetic carrier to magnetic carrier, resin may be filled only in a portion of the internal pores; or resin may be filled only in the pores in the vicinity of the surface of the ferrite-type core material particle and pores may remain in the interior; or the interior pores may be completely filled by resin.

There are no particular limitations on the method for filling resin into the pores of the ferrite-type core material particle, and can be exemplified by a method in which a resin solution of resin mixed with solvent is impregnated into the ferrite-type core material particle by a coating method such as immersion methods, spray methods, brushing methods, and fluidized bed, whereafter the solvent is made to evaporate.

This solvent should be able to dissolve the resin. For the case of an organic solvent-soluble resin, the organic solvent can be exemplified by toluene, xylene, butyl cellosolve acetate, methyl ethyl ketone, methyl isobutyl ketone, and methanol. Water may be used as the solvent in the case of water-soluble resins and emulsion-type resins.

The amount of the resin solid fraction in this resin solution is preferably at least 1 mass % and not more than 50 mass % and more preferably is at least 1 mass % and not more than 30 mass %.

A thermoplastic resin or a thermosetting resin may be used as the filling resin. A resin that exhibits a high affinity for the ferrite-type core material particle is preferred. When a resin having a high affinity is used, the surface of the ferrite-type core material particle can then also be coated by the resin at the same time as the filling of the resin into the pores of the ferrite-type core material particle.

The following are examples of thermoplastic resins for use as the filling resin: novolac resins, saturated alkyl polyester resins, polyarylates, polyamide resins, and acrylic resins.

The thermosetting resins can be exemplified by the following: phenolic resins, epoxy resins, unsaturated polyester resins, and silicone resins such as methylphenylsilicone resins and methylsilicone resins.

Viewed from the perspective of the environmental stability, halftone density reproducibility, and preventing a rise in charge in a normal-temperature, low-humidity environment, the ferrite-type core material particle having at least a portion of the pores in the particle filled with resin preferably has a true density of at least 3.4 g/cm$^3$ and not more than 4.7 g/cm$^3$.

The toner used in combination with the magnetic carrier of the present invention will now be described.

The toner has a toner particle and optionally an external additive. The toner particle contains a binder resin and optionally a colorant and a release agent.

The binder resin used in the toner particle can be exemplified by vinyl resins, polyester resins, and epoxy resins. Vinyl resins and polyester resins are preferred thereamong from the standpoint of the charging performance and fixing performance.

The following can optionally be used in the present invention mixed into the binder resin: homopolymers and copolymers of vinyl monomers, polyester resins, polyurethane resins, epoxy resins, polyvinyl butyral, rosin, modified rosin, terpene resins, phenolic resins, aliphatic hydrocarbon resins, alicyclic hydrocarbon resins, and aromatic petroleum resins.

When a mixture of two or more resins is used as the binder resin for the toner particle, a mixture of resins having different molecular weights is preferably used.

The glass transition temperature of the binder resin is preferably at least 45° C. and not more than 80° C. and is more preferably at least 55° C. and not more than 70° C.

The number-average molecular weight (Mn) of the binder resin is preferably at least 2,500 and not more than 50,000.

The weight-average molecular weight (Mw) of the binder resin is preferably at least 10,000 and not more than 1,000,000.

The polyester resin here is preferably a polyester resin in which, of the total components constituting the polyester resin, at least 45 mol % and not more than 55 mol % is the alcohol component and not more than 55 mol % and at least 45 mol % is the acid component.

The acid value of the polyester resin is preferably not more than 90 mg KOH/g and more preferably not more than 50 mg KOH/g. The hydroxyl value of the polyester is preferably not more than 50 mg KOH/g and more preferably not more than 30 mg KOH/g.

When the acid value and the hydroxyl value of the polyester resin are in the indicated ranges, the environmental dependence of the charging characteristics of the toner then tends to be small.

The glass transition temperature of the polyester resin is preferably at least 50° C. and not more than 75° C. and is more preferably at least 55° C. and not more than 65° C.

The number-average molecular weight (Mn) of the polyester resin is preferably at least 1,500 and not more than 50,000 and more preferably at least 2,000 and not more than 20,000.

The weight-average molecular weight (Mw) of the polyester resin is preferably at least 6,000 and not more than 100,000 and more preferably at least 10,000 and not more than 90,000.

When a magnetic toner is used as the toner, the magnetic body present in the magnetic toner particle constituting the magnetic toner can be exemplified by iron oxides such as magnetite, maghemite, and ferrite and iron oxides that contain other metal oxides; metals such as Fe, Co, and Ni and alloys of these metals with metals such as Al, Co, Cu, Pb, Mg, Ni, Sn, Zn, Sb, Be, Bi, Cd, Ca, Mn, Se, Ti, W, and V; and mixtures of the preceding.

More specific examples are iron(II,III) oxide ($Fe_3O_4$), ferric oxide ($\gamma$-$Fe_2O_3$), iron zinc oxide ($ZnFe_2O_4$), iron yttrium oxide ($Y_3Fe_5O_{12}$), iron cadmium oxide ($CdFe_2O_4$), iron gadolinium oxide ($Gd_3Fe_5O_{12}$), iron copper oxide ($CuFezO_4$), iron lead oxide ($PbFe_{12}O_{19}$), iron nickel oxide ($NiFe_2O_4$), iron neodymium oxide ($NdFe_2O_3$), iron barium oxide ($BaFe_{12}O_{19}$), iron magnesium oxide ($MgFe_2O_4$), iron manganese oxide ($MnFe_2O_4$), iron lanthanum oxide ($LaFeO_3$), iron (Fe), cobalt (Co), and nickel (Ni).

The content of the magnetic body in the magnetic toner particle, considered with respect to 100 mass parts of the binder resin in the magnetic toner particle, is preferably at least 20 mass parts and not more than 150 mass parts and more preferably at least 50 mass parts and not more than 130 mass parts. At least 60 mass parts and not more than 120 mass parts is still more preferred.

Nonmagnetic colorant that can be used in the toner particle is exemplified by the following.

The colorant for a black toner can be exemplified by carbon black and by colorants that have been adjusted to black using a yellow colorant, a magenta colorant, and a cyan colorant as described in the following.

The colorant for a magenta toner can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Pigments such as the following are specific examples: C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, and 269; C. I. Pigment Violet 19; and C. I. Vat Red 1, 2, 10, 13, 15, 23, 29, and 35.

In addition, the colorant for a magenta toner can be exemplified by oil-soluble dyes such as C. I. Solvent Red 1, 3, 8, 23, 24, 25, 27, 30, 49, 81, 82, 83, 84, 100, 109, and 121, C. I. Disperse Red 9, C. I. Solvent Violet 8, 13, 14, 21, and 27, and C. I. Disperse Violet 1, and by basic dyes such as C. I. Basic Red 1, 2, 9, 12, 13, 14, 15, 17, 18, 22, 23, 24, 27, 29, 32, 34, 35, 36, 37, 38, 39, and 40 and C. I. Basic Violet 1, 3, 7, 10, 14, 15, 21, 25, 26, 27, and 28.

The colorant for a cyan toner can be exemplified by pigments such as C. I. Pigment Blue 1, 2, 3, 7, 15:2, 15:3, 15:4, 16, 17, 60, 62, and 66; C. I. Vat Blue 6; C. I. Acid Blue 45; and copper phthalocyanine pigments in which at least 1 and not more than 5 phthalimidomethyl groups are substituted on the phthalocyanine skeleton.

The colorant for a yellow toner can be exemplified by pigments such as condensed azo compounds, isoindolinone compounds, anthraquinone compounds, azo metal compounds, methine compounds, and allylamide compounds. Specific examples are as follows: C. I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, and 191, and C. I. Vat Yellow 1, 3, and 20.

Additional examples of the colorant for a yellow toner are dyes such as C. I. Direct Green 6, C. I. Basic Green 4, C. I. Basic Green 6, and C. I. Solvent Yellow 162.

A pigment alone may be used for the colorant; however, a dye and a pigment may be used in combination from the standpoint of raising the sharpness and raising the quality of the full color image.

The content of the colorant in the toner particle, expressed with respect to 100 mass parts of the binder resin in the toner particle, is preferably at least 0.1 mass parts and not more than 30 mass parts and is more preferably at least 0.5 mass parts and not more than 20 mass parts. At least 3 mass parts and not more than 15 mass parts is still more preferred.

In addition, a masterbatch (colorant masterbatch) made by mixing the colorant in advance with the binder resin is preferably used to produce the toner particle. A thorough dispersion of the colorant in the toner particle can be brought about by melt-kneading this colorant masterbatch with the other starting materials (e.g., binder resin, release agent, and so forth).

A charge control agent may as necessary be incorporated in the toner particle in order to stabilize its charging performance.

The content of the charge control agent in the toner particle is preferably at least 0.5 mass parts and not more than 10 mass parts per 100 mass parts of the binder resin in the toner particle. More favorable charging characteristics are obtained at 0.5 mass parts and above. At 10 mass parts and below, a decline in the compatibility with the other materials can be suppressed and overcharging in low-humidity environments can be inhibited.

Negative charge control agents, which control the toner particle to negative chargeability, can be exemplified by organometal complexes and chelate compounds. Specific examples are monoazo metal complexes, metal complexes of aromatic hydroxycarboxylic acids, and metal complexes of aromatic dicarboxylic acids. Other examples are aromatic hydroxycarboxylic acids, aromatic monocarboxylic acids, and aromatic polycarboxylic acids and their metal salts, anhydrides, and esters, and also phenol derivatives of bisphenols.

Positive charge control agents, which control the toner particle to positive chargeability, can be exemplified by nigrosine and its modifications by, for example, fatty acid metal salts; quaternary ammonium salts such as tributylbenzylammonium 1-hydroxy-4-naphthosulfonate and tetrabutylammonium tetrafluoroborate; onium salts such as phosphonium salts; triphenylmethane dyes and their lake pigments (the laking agent can be, for example, phosphotungstic acid, phosphomolybdic acid, phosphotungstomolybdic acid, tannic acid, lauric acid, gallic acid, ferricyanic acid, and ferrocyanide); diorganotin oxides such as dibutyltin oxide, dioctyltin oxide, and dicyclohexyltin oxide; and diorganotin borates such as dibutyltin borate, dioctyltin borate, and dicyclohexyltin borate.

The toner particle may optionally contain one or more release agents.

The release agent can be exemplified by aliphatic hydrocarbon waxes such as low molecular weight polyethylenes, low molecular weight polypropylenes, microcrystalline waxes, and paraffin waxes.

Other examples of the release agent are the oxides of aliphatic hydrocarbon waxes, e.g., oxidized polyethylene waxes, and their block copolymers; waxes in which the main component is a fatty acid ester, such as carnauba wax, sasol wax, and montanic acid ester wax; and partially or fully deacidified fatty acid esters, e.g., deacidified carnauba wax.

The content of the release agent in the toner particle, expressed per 100 mass parts of the binder resin in the toner particle, is preferably at least 0.1 mass parts and not more than 20 mass parts and is more preferably at least 0.5 mass parts and not more than 10 mass parts.

In addition, the melting point of the release agent, defined as the temperature of the maximum endothermic peak during temperature ramp up in measurement by differential scanning calorimetry (DSC), is preferably at least 65° C. and not more than 130° C. and is more preferably at least 80° C. and not more than 125° C. When the melting point is at least 65° C., this suppresses a reduction in the viscosity of the toner and inhibits the occurrence of adhesion by the toner to the electrophotographic photosensitive member. A satisfactory low-temperature fixability is obtained when the melting point is not more than 130° C.

A crystalline polyester may as necessary be incorporated in the toner particle.

The crystalline polyester is preferably a crystalline polyester obtained by the condensation polymerization of an aliphatic diol having 6 to 12 carbons and an aliphatic dicarboxylic acid having 6 to 12 carbons. This aliphatic diol and aliphatic dicarboxylic acid are preferably saturated and are preferably linear. Here, crystalline means that a clear endothermic peak is observed in the curve for the change in the reversible specific heat in measurement of the change in specific heat by differential scanning calorimetry (DSC).

An external additive (flowability improver) may also be externally added to the toner particle considering, for example, improving the flowability.

The external additive can be exemplified by fluororesin particles such as vinylidene fluoride particles and polytetrafluoroethylene particles and by inorganic particles such as titanium oxide particles, alumina particles, and silica particles, e.g., silica particles produced by a wet method and silica particles produced by a dry method.

The inorganic particle is preferably an inorganic particle that has been subjected to a hydrophobic treatment by the execution of a surface treatment using, e.g., a silane coupling agent, titanium coupling agent, or silicone oil. Specifically, an inorganic oxide particle is preferred that has been treated so as to exhibit a value in the range of at least 30 and not more than 80 for the degree of hydrophobicity as measured by the methanol titration test.

The content of the external additive in the toner, expressed per 100 mass parts of the toner particle, is preferably at least 0.1 mass parts and not more than 10 mass parts and more preferably at least 0.2 mass parts and not more than 8 mass parts.

The magnetic carrier of the present invention can be used as a two-component developer that contains the magnetic carrier and a toner having a toner particle that contains a binder resin and optionally a colorant and a release agent.

When the magnetic carrier of the present invention is mixed with a toner and used as a two-component developer, the content of the toner (toner concentration) in the two-component developer is preferably at least 2 mass % and not more than 15 mass %. At least 4 mass % and not more than 13 mass % is more preferred. Reductions in the output image density are suppressed at 2 mass % and above, while the occurrence of toner scattering within the image-forming apparatus (scattering in the apparatus) and the occurrence of fogging in the output image are suppressed at 15 mass % and below.

A two-component developer containing the magnetic carrier of the present invention can be used in an image-forming method that has a charging step of charging an electrostatic latent image-bearing member; an electrostatic latent image-forming step of forming an electrostatic latent image on a surface of the electrostatic latent image-bearing member; a developing step of forming a toner image by developing the electrostatic latent image using the two-component developer; a transfer step of transferring the toner image, via an intermediate transfer member or without an intermediate transfer member, to a transfer material; and a fixing step of fixing the transferred toner image to the transfer material.

The magnetic carrier of the present invention can also be used in the aforementioned image-forming method in a replenishing developer that is fed, in correspondence to the decline in the toner concentration of the two-component developer within a developing device, to the developing device. This image-forming method may have a configuration in which the magnetic carrier that has become present in excess in the developing device is discharged from the developing device as necessary.

In addition, this replenishing developer contains the magnetic carrier and a toner having a toner particle that contains a binder resin and as necessary a colorant and a release agent.

This replenishing developer contains at least 2 mass parts and not more than 50 mass parts of toner per 1 mass parts of the magnetic carrier of the present invention. The replenishing developer may not contain magnetic carrier and may then be only toner.

A description follows of an image-forming apparatus (an electrophotographic apparatus) that is provided with a developing apparatus that uses a magnetic carrier-containing two-component developer and replenishing developer.

<Image-Forming Method>

Referring to FIG. 1, an electrophotographic photosensitive member 1, which is an electrostatic latent image bearing member, rotates in the direction indicated by the arrow in FIG. 1. The surface of the electrophotographic photosensitive member 1 is charged by a charging device 2, which is a charging means, and the surface of the charged electrophotographic photosensitive member 1 is then irradiated with image-wise exposure light by an image-wise exposure device 3, which is an image-wise exposure means (latent electrostatic image-forming means), and an electrostatic latent image is thereby formed. A developing device 4, which is a developing means, has a developer container 5 holding a two-component developer.

A developer bearing member 6 is disposed in a rotatable condition in the developing device 4. In its interior, the developer bearing member 6 houses a magnet 7 that functions as a magnetic field-generating means. At least one magnet 7 is disposed in a position facing the electrophotographic photosensitive member 1. The two-component developer is held on the developer bearing member 6 by the magnetic field of the magnet 7; the amount of the two-component developer is controlled by the control member 8; and the two-component developer is transported to the developing zone, which resides opposite from the electrophotographic photosensitive member 1. A magnetic brush is formed in the developing zone by the magnetic field generated by the magnet 7.

The electrostatic latent image is then developed (visualized) as a toner image by the application to the developer bearing member of a developing bias, which is provided by superimposing an alternating electrical field on a direct current electrical field. The toner image formed on the surface of the electrophotographic photosensitive member 1 is electrostatically transferred to a recording medium (transfer material) 12 by a transfer charging device 11, which is a transfer means.

Figure 2:
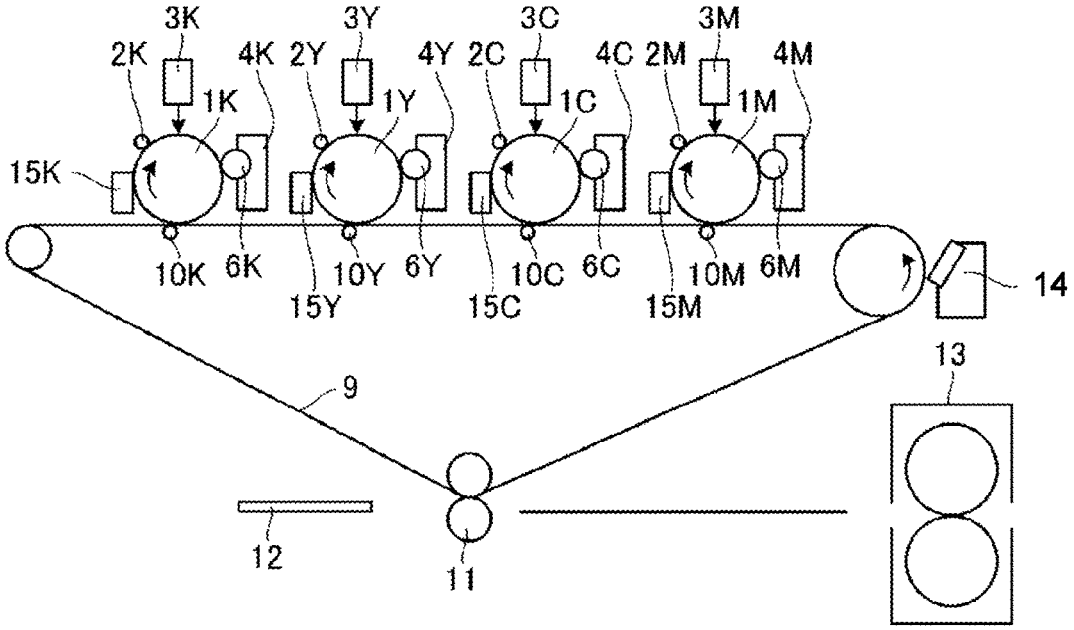
FIG. 2 is a schematic diagram of a full color image-forming apparatus.

Here, as shown in FIG. 2, a temporary transfer (primary transfer) may be carried out of the toner image to an intermediate transfer member 9 from the electrophotographic photosensitive member 1, after which a transfer (secondary transfer) to the recording medium 12 may be carried out electrostatically. The recording medium 12 is then transported to a fixing unit 13, which is a fixing means, and here the toner image is fixed on the recording medium 12 by the application of heat and pressure. This is followed by discharge of the recording medium 12 from the image-forming apparatus as the output image. A cleaner 15, which is a cleaning means, removes the toner (untransferred toner) that remains on the surface of the electrophotographic photosensitive member 1 after the transfer step. After this, the surface of the electrophotographic photosensitive member 1, now cleaned by the cleaner 15, is electrically initialized by irradiation with pre-exposure light from a pre-exposure device 16, which is a pre-exposure means, and this image-forming process described in the preceding is then repeated.

FIG. 2 gives an example of a schematic diagram of the application of the image-forming method of the present invention to a full-color image-forming apparatus.

In FIG. 2, K refers to black, Y refers to yellow, C refers to cyan, and M refers to magenta. The electrophotographic photosensitive members 1K, 1Y, 1C, 1M rotate in the direction of the arrows in FIG. 2. The surface of the electrophotographic photosensitive member 1K, 1Y, 1C, and 1M for each color is charged, respectively, by a charging device 2K, 2Y, 2C, 2M, which is a charging means. The surface of the charged electrophotographic photosensitive member 1K, 1Y, 1C, 1M for each color is then irradiated with image-wise exposure light by an image-wise exposure device 3K, 3Y, 3C, 3M, which is an image-wise exposure means (electrostatic latent image-forming means), and an electrostatic latent image is thereby formed. Each electrostatic latent image is subsequently developed (visualized) as a toner image by the two-component developer carried on a developer bearing member 6K, 6Y, 6C, 6M disposed in a developing device 4K, 4Y, 4C, 4M, which is a developing means. The toner image is transferred (primary transfer) by a primary transfer charging device 10K, 10Y, 10C, 10M, which is a primary transfer means, to an intermediate transfer member 9. The toner image is further transferred (secondary transfer) to the recording medium 12 by the secondary transfer charging device 11, which is a secondary transfer means.

The recording medium 12 is then transported to a fixing unit 13, which is a fixing means, and here the toner image is fixed on the recording medium 12 by the application of heat and pressure. This is followed by discharge of the recording medium 12 from the image-forming apparatus as the output image. After the secondary transfer step, an intermediate transfer member cleaner 14, which is a cleaning means for the intermediate transfer member 9, removes the untransferred toner, etc. After the primary transfer step, the toner remaining on the surface of the electrophotographic photosensitive member 1K, 1Y, 1C, 1M is removed by a cleaner 15K, 15Y, 15C, 15M, which is a cleaning means.

In a preferred development method using the two-component developer of the present invention, development is carried out in a configuration in which the magnetic brush is in contact with the electrophotographic photosensitive member while an alternating electric field is being formed in the developing zone by the application of an alternating current voltage to the developer bearing member. Viewed from the perspective of preventing carrier adhesion and improving the dot reproducibility, the gap between the developer bearing member 6 and the electrophotographic photosensitive member is preferably at least 100 μm and not more than 1000 μm. At 100 μm and above, a satisfactory feed of the two-component developer is obtained and reductions in the output image density are suppressed. At 1000 μm and below, broadening of the magnetic lines of force from the magnetic pole is suppressed; reductions in the density of the magnetic brush are inhibited; and reductions in the dot reproducibility are suppressed. In addition, weakening of the forces that restrain the magnetic carrier is inhibited and the appearance of magnetic carrier adhesion is inhibited.

The peak-to-peak voltage (Vpp) of the alternating electric field is preferably at least 300 V and not more than 3,000 V and is more preferably at least 500 V and not more than 1,800 V. The frequency of the alternating electric field is preferably at least 500 Hz and not more than 10,000 Hz and is more preferably at least 1,000 Hz and not more than 7,000 Hz. In this case, the waveform of the alternating current bias for forming the alternating electric field can be, for example, a triangular wave, a rectangular wave, a sine wave, or a waveform with a variable duty ratio. In order to accommodate variations in the toner image formation rate, development is preferably carried out by applying, to the developer bearing member, a developing bias voltage that has a non-continuous alternating current bias voltage (intermittent alternating superimposed voltage). A satisfactory image density is readily obtained and fogging toner in nonimage areas is easily recovered when the applied voltage is at least 300 V. At 3,000 V and below, the production of perturbations of the electrostatic latent image by the magnetic brush is suppressed.

By using a two-component developer having a well-charged toner, the defogging voltage (Vback) can be reduced and the primary charging of the electrophotographic photosensitive member can be reduced, and the life of the electrophotographic photosensitive member can be lengthened as a result. Vback is preferably not more than 200 V and is more preferably not more than 150 V. Viewed from the perspective of producing a satisfactory image density, the contrast potential is preferably at least 100 V and not more than 400 V.

When the frequency is at least 500 Hz, this makes it possible to use an electrophotographic photosensitive member as is used in common image-forming apparatuses (electrophotographic apparatuses). The electrophotographic photosensitive member can be exemplified by an electrophotographic photosensitive member that has a structure in which, for example, a conductive layer, an undercoat layer, a charge generation layer, and a charge transport layer are disposed in this sequence on a conductive support, e.g., aluminum, stainless steel (SUS), and so forth. As necessary, a protective layer may also be disposed on the charge transport layer.

The conductive layer, undercoat layer, charge generation layer, and charge transport layer can be those commonly used in electrophotographic photosensitive members.

<Method of Measuring the Volume-Average Particle Diameter (D50) of the Magnetic Carrier, Ferrite-Type Core Material, and Ferrite-Type Core Material Particle>

Measurement of the particle size distribution and so forth was carried out using a laser diffraction·scattering particle size distribution analyzer (product name: Microtrac MT3300EX, Nikkiso Co., Ltd.).

The measurement of the volume-average particle diameter (D50) of the magnetic carrier and so forth was carried out with a sample feeder for dry measurement (product name: Turbotrac One-Shot Dry Sample Conditioner, Nikkiso Co., Ltd.) installed. Using a dust collector as the vacuum source, the Turbotrac feed conditions were an air current of 33 L/second and a pressure of 17 kPa. Control was carried out automatically by software. The 50% particle diameter (D50), which is the cumulative value of the volume average, was determined for the particle diameter. Control and analysis was carried out using the provided software (version 10.3.3-202D). The measurement conditions are given below.

Set Zero time: 10 seconds
measurement time: 10 seconds
number of measurements: 1
particle refractive index: 1.81%
particle shape: nonspherical
measurement upper limit: 1408 μm
measurement lower limit: 0.243 μm
measurement environment: temperature 23° C./humidity 50% RH <Method of Measuring the Weight-Average Particle Diameter (D4) and the Number-Average Particle Diameter (D1) of the Toner>

A precision particle size distribution measurement instrument operating on the pore electrical resistance method and equipped with a 100 μm aperture tube (product name: Coulter Counter Multisizer 3, Beckman Coulter, Inc.) was used for the weight-average particle diameter (D4) and the number-average particle diameter (D1) of the toner. The measurement conditions were set and the measurement data were analyzed using the dedicated software (product name: Beckman Coulter Multisizer 3 Version 3.51, Beckman Coulter, Inc.) provided with this instrument. The determinations were made using 25,000 channels for the number of effective measurement channels and carrying out analysis of the measurement data.

The aqueous electrolyte solution used for the measurements was prepared by dissolving special-grade sodium chloride in deionized water to provide a concentration of 1 mass % (product name: ISOTON II, Beckman Coulter, Inc.).

The dedicated software was configured as follows prior to measurement and analysis.

In the "modify the standard operating method (SOM)" screen in the dedicated software, the total count number in the control mode was set to 50,000 particles; the number of measurements was set to 1 time; and the Kd value was set to the value obtained using "10.0 μm standard particles" (Beckman Coulter, Inc.). The threshold value and noise level were automatically set by pressing the threshold value/noise level measurement button. The current was set to 1600 μA;

the gain was set to 2; the electrolyte was set to "ISOTON II"; and a check was entered for the post-measurement aperture tube flush.

In the "setting conversion from pulses to particle diameter" screen of the dedicated software, the bin interval was set to logarithmic particle diameter; the particle diameter bin was set to 256 particle diameter bins; and the particle diameter range was set to 2 μm to 60 μm.

The specific measurement procedure is as follows.

(1) 200 mL of the above-described aqueous electrolyte solution was introduced into a 250-mL roundbottom glass beaker intended for use with the "Multisizer 3" and this was placed in the sample stand and counterclockwise stirring with the stirrer rod was carried out at a rotation rate of 24 rotations per second. Contamination and air bubbles within the aperture tube were removed by the "aperture flush" function of the dedicated software.

(2) 30 mL of the above-described aqueous electrolyte solution was introduced into a 100-mL flatbottom glass beaker. To this was added 0.3 mL of a dilution prepared by diluting a dispersing agent (product name: Contaminon N, Wako Pure Chemical Industries, Ltd.) three-fold (mass ratio) with deionized water. "Contaminon N" is a 10 mass % aqueous solution of a neutral pH 7 detergent for cleaning precision measurement instrumentation and contains a nonionic surfactant, anionic surfactant, and organic builder.

(3) Deionized water was introduced into the water tank of an ultrasound disperser (product name: Ultrasonic Dispersion System Tetra150, Nikkaki Bios Co., Ltd.) that had an electrical output of 120 W and was equipped with two oscillators having an oscillation frequency of 50 kHz and disposed such that the phases were displaced by 180°. 2 mL of "Contaminon N" was added to this water tank.

(4) The beaker in (2) was set into the beaker holder opening on the ultrasound disperser and the ultrasound disperser was started. The vertical position of the beaker was adjusted in such a manner that the resonance condition of the surface of the aqueous electrolyte solution within the beaker was at a maximum.

(5) While the aqueous electrolyte solution within the beaker of (4) was being irradiated with ultrasound, 10 mg of the toner was added to the aqueous electrolyte solution in small aliquots and dispersion was carried out. The ultrasound dispersion treatment was continued for an additional 60 seconds. The water temperature in the water tank was controlled as appropriate during ultrasound dispersion to be at least 10° C. and not more than 40° C.

(6) Using a pipette, the dispersed toner-containing aqueous electrolyte solution of (5) was dripped into the roundbottom beaker set in the sample stand as described in (1) with adjustment to provide a measurement concentration of 5%. Measurement was then performed until the number of measured particles reached 50,000.

(7) The measurement data was analyzed by the previously cited dedicated software provided with the instrument and the weight-average particle diameter (D4) and the number-average particle diameter (D1) were calculated. When set to graph/volume % with the dedicated software, the "average diameter" on the analysis/volumetric statistical value (arithmetic average) screen is the weight-average particle diameter (D4). When set to graph/number % with the dedicated software, the "average diameter" on the analysis/numerical statistical value (arithmetic average) screen is the number-average particle diameter (D1).

<Method of Measuring the Acid Value>

The acid value is the number of milligrams of potassium hydroxide required to neutralize the acid present in 1 g of a sample. Thus, the acid value is the number of milligrams of potassium hydroxide required to neutralize, for example, the free fatty acid and the resin acid, present in 1 g of sample.

The acid value is measured in the present invention in accordance with JIS K 0070-1992. In specific terms it is measured according to the following procedure.

(1) Reagent Preparation

A phenolphthalein solution is obtained by dissolving 1.0 g of phenolphthalein in 90 mL of ethyl alcohol (95 volume %) and bringing to 100 mL by adding deionized water.

7 g of special-grade potassium hydroxide is dissolved in 5 mL of water and this is brought to 1 L by the addition of ethyl alcohol (95 volume %). This is introduced into an alkali-resistant container avoiding contact with, for example, carbon dioxide, and is allowed to stand for 3 days followed by filtration to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the aforementioned phenolphthalein solution are added, and titration is performed using the potassium hydroxide solution. The 0.1 mol/L hydrochloric acid is prepared in accordance with JIS K 8001-1998.

(2) Procedure (A) Main Test 2.0 g of the sample is exactly weighed into a 200-mL Erlenmeyer flask and 100 mL of a toluene/ethanol (2:1) mixed solution is added and dissolution is carried out over 5 hours. Several drops of the aforementioned phenolphthalein solution are added as an indicator and titration is performed using the aforementioned potassium hydroxide solution. The titration endpoint is taken to be persistence of the faint pink color of the indicator for approximately 30 seconds.

(B) Blank Test

The same titration as in the above procedure is run, but without adding the sample (that is, with only the toluene/ethanol (2:1) mixed solution).

(3) Calculation of the Acid Value

The obtained results are substituted into the following formula to calculate the acid value.

$$AV=[(B-A)\times f\times 5.61]/S$$

Here, AV: acid value (mg KOH/g); A: amount (mL) of addition of the potassium hydroxide solution in the blank test; B: amount (mL) of addition of the potassium hydroxide solution in the main test; f: factor for the potassium hydroxide solution; and S: sample (g).

<Separation of the Resin Coat Layer from the Magnetic Carrier and Fractionation of the Coating Resin a and the Coating Resin B in the Resin Coat Layer>

The method for separating the resin coat layer from the magnetic carrier can be a method in which the magnetic carrier is placed in a cup and the coating resin is eluted using toluene.

The eluted resin is fractionated using the following instrumentation.

[Instrument Configuration]

LC-908 (Japan Analytical Industry Co., Ltd.)

JRS-86 (repeat injector, Japan Analytical Industry Co., Ltd.)

JAR-2 (autosampler, Japan Analytical Industry Co., Ltd.)

FC-201 (fraction collector, Gilson, Inc.)

[Column Configuration]

JAIGEL-1H to −5H (20 mmϕ+×600 mm: preparative columns) (Japan Analytical Industry Co., Ltd.)

[Measurement Conditions]

temperature: 40° C.

solvent: THF flow rate: 5 mL/minute detector: RI

For the fractionation method, the elution times corresponding to the peak molecular weights (Mp) of the coating resin A and the coating resin B are measured in advance by the method given below for the molecular weight distribution of the coating resins, and the respective resin components before and after these are fractionated. This was followed by removal of the solvent and drying to obtain the coating resin A and the coating resin B. With regard to the structure of the resins, the coating resin A and the coating resin B were identified by identifying the atomic groups from the absorption wavenumbers obtained using a Fourier-transform infrared spectrophotometer (Spectrum One: PerkinElmer Inc.).

<Measurement of the Weight-Average Molecular Weight (Mw), Peak Molecular Weight (Mp), and Content Ratio for the Coating Resin A, Coating Resin B, and Coating Resin in the Resin Coat Layer>

The weight-average molecular weight (Mw) and peak molecular weight (Mp) of the coating resin A, coating resin B, and coating resin were measured according to the following procedure using gel permeation chromatography (GPC).

First, the measurement sample was prepared as follows.

The sample (the coating resin separated from the magnetic carrier and the coating resin A and coating resin B as fractionated using the fractionation apparatus) was mixed at a concentration of 5 mg/mL with tetrahydrofuran (THF) and this was allowed to stand for 24 hours at room temperature in order to dissolve the sample in the THF. The sample for GPC was subsequently prepared by passage through sample treatment filters (Sample Pretreatment Cartridge H-25-2, Tosoh Corporation; Ekikurodisc 25CR, Gelman Science Japan, Ltd.).

Then, using a GPC measurement instrument (HLC-8120GPC, Tosoh Corporation), measurement was carried out in accordance with the operating manual for this instrument under the following measurement conditions.

(Measurement Conditions)

instrument: "HLC8120 GPC" high-performance GPC (Tosoh Corporation)

columns: 7-column train of Shodex KF-801, 802, 803, 804, 805, 806, and 807 (SHOWA DENKO K.K.)

eluent: THF flow rate: 1.0 mL/minute oven temperature: 40.0° C.

sample injection amount: 0.10 mL

A molecular weight calibration curve constructed using polystyrene resin standards (Tosoh Corporation, TSK Standard Polystyrene F-850, F-450, F-288, F-128, F-80, F-40, F-20, F-10, F-4, F-2, F-1, A-5000, A-2500, A-1000, and A-500) was used for the calibration curve used to determine the weight-average molecular weight (Mw) and the peak molecular weight (Mp) of the sample.

Figure 3:
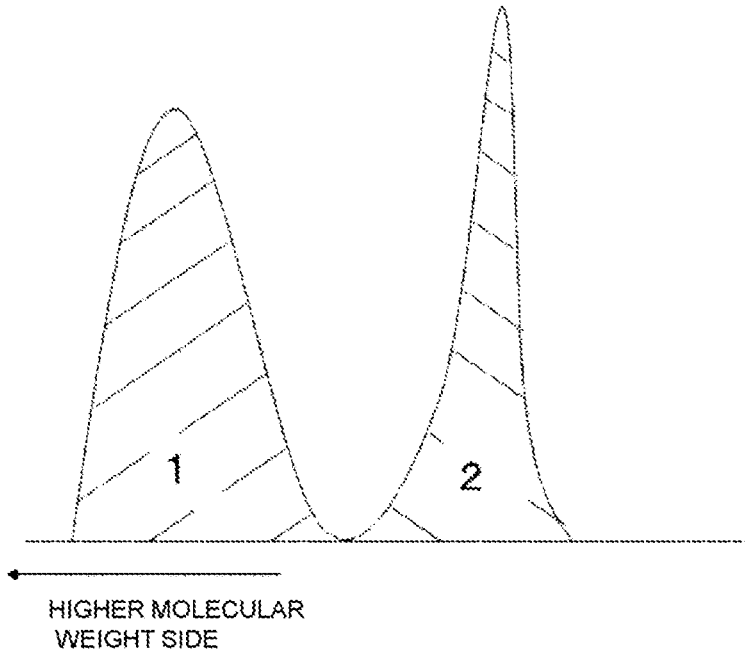
FIG. 3 is a schematic diagram of a method for defining the coating resin content in a GPC-derived molecular weight distribution curve.
Figure 4:
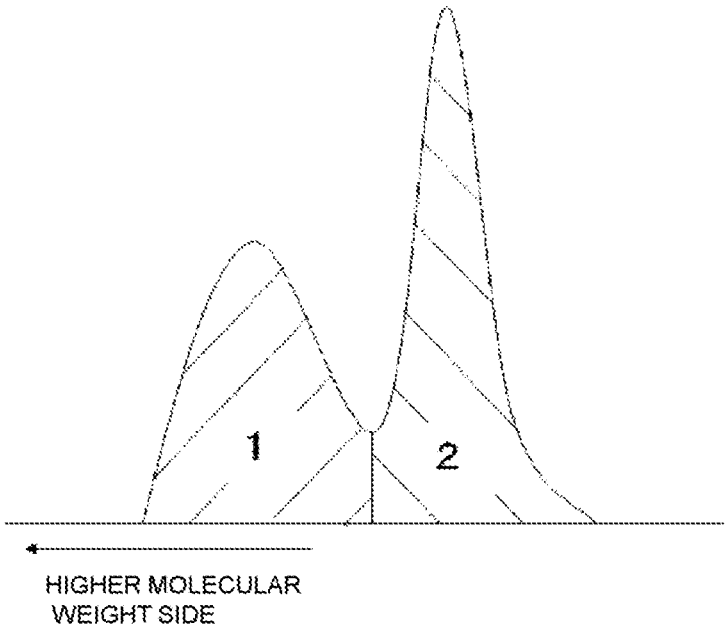
FIG. 4 is a schematic diagram of a method for defining the coating resin content in a GPC-derived molecular weight distribution curve.

In addition, the content ratio was determined using the peak area ratio in the measurement of the molecular weight distribution. As shown in FIG. 3, when the region 1 and the region 2 were completely separated, the ratio of the resin contents was determined from the area ratio of the individual regions. When these regions overlapped, as shown in FIG. 4, partitioning was carried out by a line drawn perpendicularly to the horizontal axis from the inflection point in the GPC molecular weight distribution curve and the content ratio was determined from the area ratio of the region 1 and region 2 shown in FIG. 4.

<Measurement of the Pore Diameter, Pore Volume, and Pore Distribution of the Ferrite-Type Core Material Particle>

The pore diameter, pore volume, and pore distribution of the ferrite-type core material particle were measured by the mercury intrusion method.

The measurement principle is as follows. In this measurement, the amount of mercury penetrating into the pores is measured while varying the pressure applied to the mercury. The condition at which mercury can penetrate within a pore is expressed by $PD=-4\sigma \cos\theta$ from the force equilibrium, for a pressure P and a pore diameter D where $\theta$ and $\sigma$ are, respectively, the contact angle and surface tension of the mercury. Assuming constant values for the contact angle and surface tension, the pressure P is then inversely proportional to the pore diameter D into which the mercury can penetrate at P. As a consequence, the pore distribution was acquired by building a P-V curve by measuring, at different pressures, the pressure P and the amount of fluid V penetrated at P and converting the P on the horizontal axis of this P-V curve directly to the pore diameter using the aforementioned relationship, and the pore volume was calculated.

The measurement can be carried out using, for example, a PoreMaster series·PoreMaster-GT series fully automated multifunctional mercury porosimeter from Yuasa Ionics Co., Ltd. or an Autopore IV 9500 series automated porosimeter from Shimadzu Corporation, for the measurement instrument.

Specifically, the measurement was run using the following conditions and procedure with an Autopore IV 9520 from Shimadzu Corporation.

(Measurement Conditions)

measurement environment 20° C.

measurement cell sample volume 5 $cm^3$ intrusion volume 1.1 $cm^3$ application for powder measurement range at least 2.0 psia (13.8 kPa)

not more than 59989.6 psia (413.7 MPa)

measurement steps 80 steps (the steps are set up so as to provide equal intervals when the pore diameter is converted to the logarithm)

low pressure parameters exhaust pressure 50 μmHg exhaust time 5.0 min mercury injection pressure 2.0 psia (13.8 kPa)

equilibration time 5 secs, high pressure parameter equilibration time 5 secs mercury parameters advancing contact angle 130.0 degrees receding contact angle 130.0 degrees surface tension 485.0 mN/m (485.0 dynes/cm)

density of mercury 13.5335 g/mL (Measurement Procedure)

(1) Approximately 1.0 g of the ferrite-type core material particle is weighed out and introduced into a measurement cell. The weighed out value is input.

(2) Measurement is carried out in the low pressure region at from at least 2.0 psia (13.8 kPa) and not more than 45.8 psia (315.6 kPa).

(3) Measurement was carried out in the high pressure region at from at least 45.9 psia (316.3 kPa) and not more than 59989.6 psia (413.6 MPa).

(4) The pore diameter distribution was calculated from the mercury injection pressure and the amount of mercury injection.

(2), (3), and (4) were performed automatically using the software provided with the instrument.

From the pore diameter distribution measured as above, the pore diameter is read out at which the differential pore volume assumes the maximum value in the pore diameter range of at least 0.10 μm and not more than 3.00 μm and this is taken to be the pore diameter at which the differential pore volume assumes a maximum (pore diameter for the present invention).

In addition, the pore volume provided by integrating the differential pore volume in the pore diameter range of at least 0.1 μm and not more than 3.0 μm was calculated using the provided software and was taken to be the pore volume.

<Measurement of the Resistivity (Ω·cm)>

Figure 5A:
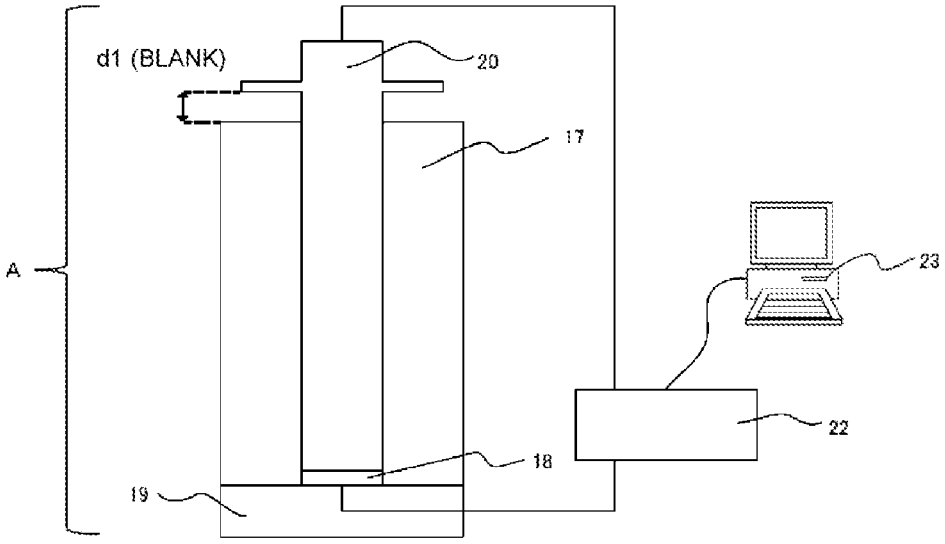
FIGS. 5A and 5B are schematic diagrams of an apparatus for measuring the resistivity of a magnetic carrier.
Figure 5B:
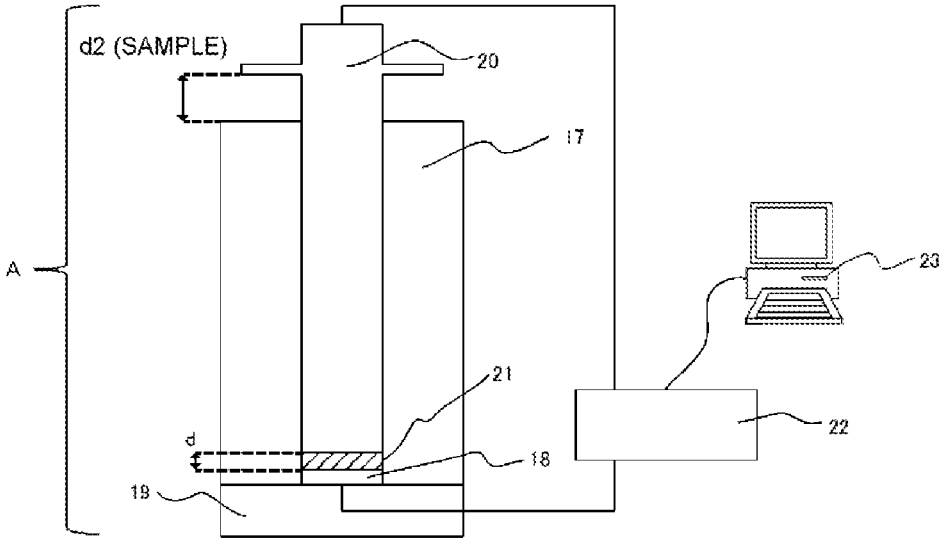

The resistivity is measured using the measurement apparatus that is schematically illustrated in FIGS. 5A and 5B.

The resistivity of the magnetic carrier is measured at a field strength of 2000 (V/cm) and the resistivity of the ferrite-type core material particle is measured at a field strength of 300 (V/cm).

A resistance measurement cell A is constituted of a cylindrical container (PTFE resin) 17 having an opening with a cross-sectional area of 2.4 $cm^2$, a lower electrode (stainless steel) 18, a support base (PTFE resin) 19, and an upper electrode (stainless steel) 20. The cylindrical container 17 is mounted on the support base 19; the sample (e.g., the magnetic carrier) 21 is filled to a thickness of approximately 1 mm; the upper electrode 20 is mounted on the filled sample 21; and the thickness of the sample is measured. The sample thickness d is then calculated using the following formula where d1 is the distance in the absence of the sample as shown in FIG. 5A and d2 is the distance when the sample has been filled to a thickness of approximately 1 mm as shown in FIG. 5B.

$$d = d2 - d1 \text{ (mm)}$$

The mass of the sample may be varied at this time as appropriate so as to make the sample thickness d be at least 0.95 mm and not more than 1.04 mm.

The resistivity of the sample can be determined by applying a direct-current voltage between the electrodes and measuring the current that flows when this is done. An electrometer 22 (Keithley 6517A from Keithley Instruments, Inc.) and a process control computer 23 are used for the measurement.

Control software (LabVIEW from National Instruments Corporation) and a control system from National Instruments Corporation were used for the process control computer.

The following are input for the measurement conditions: a contact area between the sample and electrode S=2.4 $cm^2$ and the actually measured value of d providing a sample thickness of from at least 0.95 mm to not more than 1.04 mm. In addition, the load of the upper electrode is set at 270 g.

$$\text{resistivity } (\Omega\cdot\text{cm}) = (\text{applied voltage (V)}/\text{measured current } (A)) \times S(\text{cm}^2)/d(\text{cm})$$

$$\text{field strength (V/cm)} = \text{applied voltage (V)}/d(\text{cm})$$

For the resistivity at the aforementioned field strengths for the samples, the resistivity is read from the graph at the aforementioned field strength on the graph.

<Measurement of the Film Thickness of the Resin Coat Layer>

For the film thickness of the resin coat layer, the thickness of the resin coat layer was measured by observation of the cross section of the magnetic carrier using a transmission electron microscope (TEM) (50,000× in each case).

Specifically, the magnetic carrier was subjected to ion milling using an argon ion milling apparatus (product name: E-3500, Hitachi High-Technologies Corporation) and the thickness of the resin coat layer in the magnetic carrier cross section was measured at 10 randomly selected points using a transmission electron microscope (TEM) (50,000× in each case).

This same measurement was carried out on 100 magnetic carriers and the minimum value and maximum value were selected from among the 1000 measurement values obtained for the thickness of the resin coat layer and were designated as the minimum film thickness (μm) and the maximum film thickness (μm). The ion milling measurement conditions are as follows.

beam width: 400 μm (half width)
ion gun acceleration voltage: 5 kV
ion gun discharge voltage: 4 kV
ion gun discharge current: 463 μA
ion gun irradiation current level: 90 $\mu A/cm^3/1$ min <Measurement of the True Density ($g/Cm^3$) of the Ferrite-Type Core Material>

The true density was measured using an Autopycnometer dry automatic densitometer (Yuasa Ionics Co., Ltd.).

<Measurement of the Amount of Magnetization>

The amount of magnetization was measured using the following procedure and a BHV-30 vibrating magnetic field-type magnetic property automatic recording instrument from Riken Denshi Co., Ltd.

The sample is filled sufficiently tightly in a cylindrical plastic container; an external magnetic field of 79.6 (kA/m) (1000 oersted) is generated; and the magnetization moment is measured for the sample thusly filled in the container. The actual mass of the sample filled in the container is measured and the strength of sample magnetization is calculated ($Am^2/kg$).

<Measurement of the Content of the Primer Compound in the Ferrite-Type Core Material>

The content of the primer compound in the ferrite-type core material is determined as follows. First, the resin coat layer is stripped from the magnetic carrier particle as in the measurement of the content of the resin coat layer as described below, and structure identification is then carried out, using a time-of-flight secondary ion mass spectrometer (FIB-TOF-SIMS), on the ferrite-type core material that has been stripped of the resin coat layer. Then, the content of the primer compound is calculated by measuring the total amount of nitrogen at the surface of the ferrite-type core material by JIS K 0102 45.1.

<Measurement of the Content of the Resin Coat Layer in the Magnetic Carrier>

A A 100-mL beaker is exactly weighed (measurement value 1); approximately 5 g of the sample to be measured (the magnetic carrier) is introduced; and the total mass of the sample and beaker is exactly weighed (measurement value 2).

B Approximately 50 mL of toluene is introduced into the beaker and shaking is carried out for 5 minutes using an ultrasonic shaker.

C Standing at quiescence is carried out for several minutes after the completion of shaking; using a neodymium magnet, the sample within the beaker is stirred so as to travel around the bottom of the beaker 20 times; and then only the toluene solution in which the coating resin is dissolved is drained off as a waste solution.

D While holding the sample within the beaker using the neodymium magnet from the outside, approximately 50 mL of toluene is re-introduced into the beaker and the process in B and C is repeated 10 times.

E The solvent is changed to chloroform and the process in B and C is carried out once.

F The sample and the beaker are introduced into a vacuum dryer and the solvent is removed by drying (the vacuum dryer used is equipped with a solvent trap, temperature 50° C., vacuum equal to or less than −0.093 MPa, 12 hour drying time).

G The beaker is removed from the vacuum dryer and is cooled by standing for about 20 minutes and the mass is then exactly weighed (measurement value 3).

H Using the measurement values obtained as described above, the resin coat amount (mass) is calculated using the following formula.

mass of the resin coat=(sample mass−sample mass after stripping of the resin coat layer)

The sample mass is determined by calculating (measurement value 2−measurement value 1), and the sample mass after stripping of the resin coat layer is determined by calculating (measurement value 3−measurement value 1).

<Measurement of the Content of the Primer Compound in the Resin Coat Layer>

The resin component in the resin coat layer stripped during measurement of the content of the resin coat layer as described above is identified by FIB-TOF-SIMS. When nitrogen is not present in the resin component, the content of the primer compound in the resin coat layer is calculated for the stripped resin coat layer using JIS K 0102 45.1.

EXAMPLES

The present invention is described more specifically below with reference to examples, but the present invention is not limited to only these examples. Unless specifically indicated otherwise, the number of parts and the % in the examples and comparative examples are on a mass basis in all instances.

<Coating Resin A Production Example>

The starting materials listed in Table 1 were introduced into a four-neck flask equipped with a reflux condenser, thermometer, nitrogen inlet conduit, and a grinding-type stirrer; 100 mass parts of toluene, 100 mass parts of methyl ethyl ketone, and 2.4 mass parts of azobisisovaleronitrile were also added; and a coating resin A-1 solution (35 mass % solids fraction) was then obtained by holding for 10 hours at 80° C. under a nitrogen current.

Coating resins A-2 to A-13 were also obtained proceeding in the same manner using the starting materials listed in Table 1.

A polyester resin (composed of 70 mol % bisphenol A, 20 mol % terephthalic acid, and 10 mol % trimellitic anhydride, glass transition temperature=70° C.) was used for coating resin A-14, and a straight silicone resin (TSR102, TANAC Co., Ltd.) was used for coating resin A-15. The properties are given in Table 1.

<Coating Resin B Production Example>

The starting materials listed in Table 2 were introduced into a four-neck flask equipped with a reflux condenser, thermometer, nitrogen inlet conduit, and a grinding-type stirrer; 50 mass parts of toluene, 100 mass parts of methyl ethyl ketone, and 2.4 mass parts of azobisisovaleronitrile were also added; and a coating resin B-1 solution (40 mass % solids fraction) was then obtained by holding for 10 hours at 80° C. under a nitrogen current.

Coating resins B-2 to B-5 were also obtained proceeding in the same manner using the starting materials listed in Table 2. The properties are given in Table 2.

<Coating Resin Solutions 1 to 33 Production Example>

The coating resin A and coating resin B given in Table 1 and Table 2 were mixed in the mass parts (amount of solids fraction) given in Table 3. 900 mass parts of toluene was then introduced per 100 mass parts of the total amount of the resin component and mixing was carried out until the resin component was thoroughly dissolved to prepare coating resin solutions 1 to 33.

<Ferrite-Type Core Material Particle 1 Production Example>

Step 1 (Weighing and Mixing Step)

| | |
|---|---|
| $Fe_2O_3$ | 67.5 mass % |
| $MnCO_3$ | 29.2 mass % |
| $Mg(OH)_2$ | 2.0 mass % |
| $SrCO_3$ | 1.3 mass % |

This ferrite starting material was weighed out; 20 mass parts of water was added to 80 mass parts of the ferrite starting material; and grinding was carried out to prepare a slurry. The solids fraction concentration of the slurry was 80 mass %.

Step 2 (Presintering Step)

The obtained slurry was dried using a spray dryer (Ohkawara Kakohki Co., Ltd.) followed by sintering for 3.0 hours at a temperature of 1030° C. in a batch electric furnace under a nitrogen atmosphere (1.0 volume % oxygen concentration) to produce a presintered ferrite.

Step 3 (Pulverization Step)

The obtained presintered ferrite was pulverized with a crusher to about 0.5 mm and water was then added to prepare a slurry. The solids fraction concentration of the slurry was brought to 70 mass %. This slurry was ground for 3 hours using a wet ball mill and stainless steel beads having a diameter of ⅛ inch, followed by grinding for 4 hours using a wet bead mill and zirconia having a diameter of 1 mm to obtain a presintered ferrite slurry in which the 50% particle diameter on a volume basis (D50) was 1.3 μm.

Step 4 (Granulating Step)

1.0 mass parts of an ammonium polycarboxylate as a dispersing agent and 1.5 mass parts of polyvinyl alcohol as a binder were added to the presintered ferrite slurry per 100 mass parts of the presintered ferrite, followed by granulation into spherical particles and drying using a spray dryer (Ohkawara Kakohki Co., Ltd.). The particle size of the obtained granulate was adjusted followed by heating for 2 hours at 750° C. using a rotary electric furnace to remove the organics, e.g., the dispersing agent and binder.

Step 5 (Sintering Step)

Sintering was performed under a nitrogen atmosphere (1.0 volume % oxygen concentration) using 2 hours for the time from room temperature to the sintering temperature (1100° C.) and holding for 4 hours at a temperature of 1100° C. This was followed by cooling to a temperature of 60° C.

over 8 hours, returning to the atmosphere from the nitrogen atmosphere, and removal at a temperature of 40° C. or below.

Step 6 (Classification Step)

The aggregated particles were broken up; the coarse particles were removed by sieving on a sieve with an aperture of 150 μm; the fines were removed using a wind force classifier; and the low magnetic force fraction was removed using a magnetic classifier to obtain a ferrite-type core material particle. The obtained ferrite-type core material particle was porous and had pores.

Step 7 (Filling Step)

100 mass parts of the obtained ferrite-type core material particle was introduced into the stirring container of a mixing stirrer (Model NDMV Universal Stirrer, DALTON CORPORATION) and, while holding the temperature at 60° C., nitrogen was introduced while reducing the pressure to 2.3 kPa. 50 mass parts of toluene was stirred for 10 minutes using a multiblender mixer with 50 mass parts of a methylphenylsilicone resin, and this was added dropwise to the ferrite-type core material particle therein. The amount of dropwise addition was adjusted to provide 5.0 mass parts of the resin component as the solids fraction per 100 mass parts of the ferrite-type core material particle.

After the completion of the dropwise addition, stirring was continued as it was for 2.5 hours, after which the temperature was raised to 70° C. and the solvent was removed under reduced pressure to fill the aforementioned resin composition into the particles of the ferrite-type core material particle.

After cooling, the obtained ferrite-type core material particle was transferred into a rotatable mixing container in a mixer having spiral blades (Model UD-AT Drum Mixer, Sugiyama Heavy Industrial Co., Ltd.), and heating was carried out to the 220° C. set temperature for the stirrer at a ramp rate of 2° C./minute under a nitrogen atmosphere. Stirring and heating were carried out for 1.0 hour at this temperature in order to cure the resin, and stirring was then continued for 1.0 hour while holding 200° C.

This was followed by cooling to room temperature; the ferrite-type core material particle filled with cured resin was removed; and nonmagnetic material was removed using a magnetic classifier. The coarse particles were removed on a vibrating screen to obtain a resin-filled ferrite-type core material particle 1. The 50% particle diameter based on the volume distribution (D50) of the ferrite-type core material particle 1 was 37.7 μm. The properties are reported in Table 4.

<Ferrite-Type Core Material Particles 2 and 3 Production Example>

Ferrite-type core material particles 2 and 3 were obtained proceeding as in the Ferrite-Type Core Material Particle 1 Production Example, but changing the production conditions in steps 4 to 7 and the filling resin in step 7 of the Ferrite-Type Core Material Particle 1 Production Example to those listed in Table 4. The properties are given in Table 4.

<Ferrite-Type Core Material Particle 4 Production Example>

Ferrite-type core material particle 4 was obtained proceeding as in the Ferrite-Type Core Material Particle 1 Production Example, but eliminating the pores through the sintering conditions in step 5 of the Ferrite-Type Core Material Particle 1 Production Example and omitting step 7. The properties are given in Table 4.

<Ferrite-Type Core Materials 1 to 33 Production Example>

Ferrite-type core materials 1 to 33 (indicated as core material No. 1 to 33 in Table 5) were produced by forming a primer layer (intermediate layer) of the primer compound indicated in Table 5, so as to provide the mass parts indicated in Table 5 per 100 mass parts of the ferrite-type core material particle indicated in Table 5 (indicated as core material particle No. 1 to 4 in the table). The properties are given in Table 5.

The primer layer was formed as follows. 100 mass parts of the core material particle was introduced into a planetary mixer (Model VN Nauta Mixer, Hosokawa Micron Corporation); stirring was performed using a screw-shaped stirring blade at 3.5 revolutions per minute and 100 rpm for the axial rotation; and nitrogen was injected at a flow rate of 0.1 $m^3$/minute while adjusting to bring about reduced pressure (75 mmHg). Heating to 70° C. was carried out followed by the introduction of the primer compound diluted 10× with toluene. A coating operation was performed for 20 minutes, followed by transfer into a rotatable mixing container in a mixer having spiral blades (Model UD-AT Drum Mixer, Sugiyama Heavy Industrial Co., Ltd.) and the execution of a heat treatment for 2 hours at a temperature of 150° C. under a nitrogen atmosphere while stirring by rotating the mixing container at 10 rpm.

<Magnetic Carriers 1 to 33 Production Example>

The ferrite-type core material 1 (100.0 mass parts) and the coating resin solution 1, diluted with toluene to provide a solids fraction ratio of 10%, were introduced into a planetary mixer (Model VN Nauta Mixer, Hosokawa Micron Corporation) being held under reduced pressure (1.5 kPa) at a temperature of 60° C., such that the content of the resin coat layer per 100 mass parts of the ferrite-type core material was the "total amount of resin component (mass parts)" of Table 3. In the case of magnetic carriers 7 and 8, 20 to 22, 24, and 32, the primer compound used with the ferrite-type core material was introduced at the same time such that the content of the primer compound in the resin coat layer assumed the mass % shown in Table 6.

With regard to the introduction procedure, one-half of the resin solution was first introduced to the ferrite-type core material and solvent removal and a coating operation were carried out for 30 minutes. Then, the additional one-half was introduced and solvent removal and a coating operation were carried out for 30 minutes.

The magnetic carrier coated with the coat resin composition was then transferred into a rotatable mixing container in a mixer having spiral blades (Model UD-AT Drum Mixer, Sugiyama Heavy Industrial Co., Ltd.). While stirring by rotating the mixing container at 10 rpm, a heat treatment was performed for 2 hours at a temperature of 120° C. under a nitrogen atmosphere. The obtained magnetic carrier was subjected to separation of the low magnetic force product by magnetic classification, passage through a sieve with an aperture of 150 μm, and classification using a wind force classifier to obtain a magnetic carrier 1.

The magnetic carriers 2 to 33 were obtained proceeding as for magnetic carrier 1 using the coating resin solutions 2 to 33 on the ferrite-type core materials 2 to 33 such that the content of the resin coat layer with respect to 100 mass parts of the particular ferrite-type core material assumed the "total amount of resin component (mass parts)" in Table 3. The properties values of the obtained magnetic carriers 1 to 33 are given in Table 6.

TABLE 1

| | main chain monomer | | macromonomer | | | | |
|---|---|---|---|---|---|---|---|
| | constituent monomer | amount of addition (mass parts) | constituent monomer | weight-average molecular weight (Mw) | amount of addition (mass parts) | weight-average molecular weight (Mw) | acid value (mg KOH/g) |
| resin A-1 | cyclohexyl methacrylate | 74.5 | methyl methacrylate | 5000 | 25.0 | 54,000 | 0.5 |
| | methyl methacrylate | 0.5 | | | | | |
| resin A-2 | cyclohexyl methacrylate | 80.0 | methyl methacrylate | 5000 | 20.0 | 48,000 | 0.2 |
| resin A-3 | dicyclopentanyl acrylate | 60.0 | methyl methacrylate | 5000 | 20.0 | 79,000 | 1.0 |
| | methyl methacrylate | 19.8 | | | | | |
| | methacrylic acid | 0.2 | | | | | |
| resin A-4 | cyclohexyl methacrylate | 74.4 | styrene | 5000 | 20.0 | 45,000 | 2.5 |
| | methyl methacrylate | 5.0 | | | | | |
| | methacrylic acid | 0.6 | | | | | |
| resin A-5 | cyclohexyl methacrylate | 75.0 | styrene | 5000 | 20.0 | 53,000 | 0.5 |
| | methyl methacrylate | 5.0 | | | | | |
| resin A-6 | cyclohexyl methacrylate | 75.0 | acrylonitrile | 5000 | 20.0 | 55,000 | 0.5 |
| | methyl methacrylate | 5.0 | | | | | |
| resin A-7 | cyclohexyl methacrylate | 80.0 | — | — | — | 55,000 | 1.5 |
| | methyl methacrylate | 19.7 | | | | | |
| | methacrylic acid | 0.3 | | | | | |
| resin A-8 | dicyclopentanyl acrylate | 20.0 | 2-ethylhexyl methacrylate | 3000 | 15.0 | 67,000 | 2.7 |
| | cyclohexyl methacrylate | 60.0 | | | | | |
| | methyl methacrylate | 4.4 | | | | | |
| | methacrylic acid | 0.6 | | | | | |
| resin A-9 | dicyclopentanyl acrylate | 15.0 | 2-ethylhexyl methacrylate | 3000 | 20.0 | 70,000 | 0.1 |
| | cyclohexyl methacrylate | 60.0 | | | | | |
| | methyl methacrylate | 5.0 | | | | | |
| resin A-10 | dicyclopentanyl acrylate | 20.0 | butyl methacrylate | 4000 | 10.0 | 96,000 | 3.5 |
| | cyclohexyl methacrylate | 60.0 | | | | | |
| | methyl methacrylate | 9.2 | | | | | |
| | methacrylic acid | 0.8 | | | | | |
| resin A-11 | methyl methacrylate | 95.0 | — | — | — | 55,000 | 1.0 |
| | tert-butyl methacrylate | 4.8 | | | | | |
| | methacrylic acid | 0.2 | | | | | |
| resin A-12 | methyl methacrylate | 70.0 | — | — | — | 55,000 | 0.1 |
| | styrene | 20.0 | | | | | |
| | 2-hydroxyethyl methacrylate | 10.0 | | | | | |
| resin A-13 | 2-(perfluorooctyl)ethyl methacrylate | 60.0 | — | — | — | 65,000 | 0.1 |
| | methyl methacrylate | 40.0 | | | | | |
| resin A-14 | polyester resin | | | | | 75,000 | 20.5 |
| resin A-15 | straight silicone resin | | | | | | |

TABLE 2

| | monomer | | weight- | |
|---|---|---|---|---|
| | constituent monomer | amount of addition (mass parts) | average molecular weight (Mw) | acid value (mg KOH/g) |
| resin B-1 | methyl methacrylate | 80.0 | 38,000 | 6.2 |
| | isobutyl methacrylate | 18.6 | | |
| | methacrylic acid | 1.4 | | |
| resin B-2 | methyl methacrylate | 79.9 | 36,000 | 4.0 |
| | isobutyl methacrylate | 19.2 | | |
| | methacrylic acid | 0.9 | | |

TABLE 2-continued

| | monomer | | weight- | |
|---|---|---|---|---|
| | constituent monomer | amount of addition (mass parts) | average molecular weight (Mw) | acid value (mg KOH/g) |
| resin B-3 | methyl methacrylate | 71.0 | 38,000 | 45.0 |
| | isobutyl methacrylate | 20.0 | | |
| | acrylic acid | 9.0 | | |
| resin B-4 | methyl methacrylate | 80.0 | 85,000 | 3.0 |
| | isobutyl methacrylate | 19.6 | | |
| | acrylic acid | 0.4 | | |
| resin B-5 | methyl methacrylate | 70.0 | 30,000 | 55.0 |
| | isobutyl methacrylate | 20.0 | | |
| | acrylic acid | 10.0 | | |

TABLE 3

| coating resin solution No. | resin A: resin designation | resin A: amount of addition (mass parts) | resin B: resin designation | resin B: amount of addition (mass parts) | peak area ratio for coating resin A (%) | total amount of resin component (mass parts) | acid value of resin coat layer (mg KOH/g) |
|---|---|---|---|---|---|---|---|
| 1 | resin A-1 | 1.50 | resin B-1 | 0.50 | 75 | 2.00 | 1.9 |
| 2 | resin A-2 | 1.00 | resin B-1 | 1.00 | 50 | 2.00 | 3.2 |
| 3 | resin A-2 | 2.00 | — | — | 100 | 2.00 | 0.2 |
| 4 | resin A-2 | 1.50 | — | — | 100 | 1.50 | 0.2 |
| 5 | resin A-1 | 1.80 | resin B-1 | 0.50 | 78 | 2.30 | 1.7 |
| 6 | resin A-1 | 1.00 | resin B-1 | 0.20 | 83 | 1.20 | 1.5 |
| 7 | resin A-3 | 1.20 | resin B-2 | 0.60 | 67 | 1.80 | 2.0 |
| 8 | resin A-1 | 0.80 | resin B-3 | 0.40 | 67 | 1.20 | 15.3 |
| 9 | resin A-1 | 2.70 | resin B-1 | 1.80 | 60 | 4.50 | 2.8 |
| 10 | resin A-4 | 1.20 | resin B-2 | 0.60 | 67 | 1.80 | 3.0 |
| 11 | resin A-5 | 1.80 | — | — | 100 | 1.80 | 0.5 |
| 12 | resin A-5 | 1.80 | — | — | 100 | 1.80 | 0.5 |
| 13 | resin A-6 | 1.80 | — | — | 100 | 1.80 | 0.5 |
| 14 | resin A-7 | 2.00 | — | — | 100 | 2.00 | 1.5 |
| 15 | resin A-7 | 1.50 | resin B-3 | 0.50 | 75 | 2.00 | 12.4 |
| 16 | resin A-8 | 0.50 | resin B-4 | 1.50 | 25 | 2.00 | 2.9 |
| 17 | resin A-9 | 1.70 | resin B-5 | 0.30 | 85 | 2.00 | 8.3 |
| 18 | resin A-10 | 1.25 | resin B-2 | 0.75 | 63 | 2.00 | 3.7 |
| 19 | resin A-7 | 1.70 | resin B-3 | 0.30 | 85 | 2.00 | 8.0 |
| 20 | resin A-7 | 1.80 | — | — | 100 | 1.80 | 1.5 |
| 21 | resin A-7 | 0.40 | resin B-2 | 0.30 | 57 | 0.70 | 2.6 |
| 22 | resin A-7 | 3.60 | resin B-5 | 1.20 | 75 | 4.80 | 15.3 |
| 23 | resin A-2 | 1.25 | resin B-1 | 0.75 | 63 | 2.00 | 2.4 |
| 24 | resin A-2 | 1.50 | resin B-1 | 0.50 | 75 | 2.00 | 2.4 |
| 25 | resin A-2 | 0.40 | — | — | — | 0.40 | 0.2 |
| 26 | resin A-2 | 5.30 | — | — | — | 5.30 | 0.2 |
| 27 | resin A-11 | 1.20 | — | — | — | 1.20 | 1.0 |
| 28 | resin A-12 | 1.50 | — | — | — | 1.50 | 0.1 |
| 29 | resin A-13 | 1.50 | — | — | — | 1.50 | 0.1 |
| 30 | resin A-14 | 1.50 | — | — | — | 1.50 | 20.5 |
| 31 | resin A-15 | 2.00 | — | — | — | 2.00 | — |
| 32 | resin A-15 | 3.00 | — | — | — | 3.00 | — |
| 33 | resin A-2 | 3.00 | — | — | — | 3.00 | 0.2 |

TABLE 4

| ferrite-type core material particle No. | volume-average particle diameter D50 (μm) | mercury intrusion method: pore diameter (μm) | mercury intrusion method: pore volume ($mm^3/g$) | filled resin designation | amount of solids fraction (mass parts) | amount of magnetization ($Am^2/kg$) |
|---|---|---|---|---|---|---|
| 1 | 37.7 | 0.65 | 65 | methylphenylsilicone | 5.0 | 51.5 |
| 2 | 60.5 | 0.76 | 80 | phenol | 4.0 | 55.3 |
| 3 | 41.0 | 1.30 | 98 | methylsilicone | 6.0 | 49.6 |
| 4 | 53.6 | — | — | — | — | 57.2 |

TABLE 5

| core material No. | core material particle No. | primer compound | primer compound content mass parts) | particle diameter (D50) (μm) | true density ($g/cm^3$) |
|---|---|---|---|---|---|
| 1 | 1 | 3-aminopropyltrimethoxysilane | 0.040 | 40.5 | 4.05 |
| 2 | 1 | 3-aminopropyldiethoxymethylsilane | 0.040 | 40.2 | 4.09 |
| 3 | 1 | 3-(2-aminoethylamino)propyltrimethoxysilane | 0.030 | 40.1 | 4.10 |
| 4 | 1 | 3-(2-aminoethylamino)propyldimethoxymethylsilane | 0.030 | 40.1 | 4.09 |
| 5 | 1 | trimethoxy[3-(methylamino)propyl]silane | 0.040 | 40.6 | 4.04 |
| 6 | 4 | 3-aminopropyldimethoxymethylsilane | 0.040 | 55.3 | 4.82 |
| 7 | 1 | 3-aminopropyltriethoxysilane | 0.050 | 40.7 | 4.04 |
| 8 | 1 | 3-aminopropyltriethoxysilane | 0.030 | 39.1 | 4.13 |
| 9 | 1 | trimethoxy[3-(phenylamino)propyl]silane | 0.060 | 41.6 | 3.95 |
| 10 | 1 | 3-(2-aminoethylamino)propyltriethoxysilane | 0.015 | 40.0 | 4.09 |

TABLE 5-continued

| core material No. | core material particle No. | primer compound | primer compound content mass parts) | particle diameter (D50) (μm) | true density (g/cm$^3$) |
|---|---|---|---|---|---|
| 11 | 1 | 3-aminopropyldimethoxymethylsilane | 0.065 | 40.2 | 4.08 |
| 12 | 2 | 3-aminopropyltriethoxysilane | 0.075 | 62.8 | 4.26 |
| 13 | 2 | 3-aminopropyltriethoxysilane | 0.084 | 62.7 | 4.27 |
| 14 | 1 | 3-(2-aminoethylamino)propyltriethoxysilane | 0.040 | 40.4 | 4.05 |
| 15 | 1 | 3-aminopropyltriethoxysilane | 0.040 | 40.2 | 4.05 |
| 16 | 3 | 3-aminopropyltriethoxysilane | 0.040 | 43.7 | 3.94 |
| 17 | 3 | 3-aminopropyltriethoxysilane | 0.040 | 43.5 | 3.89 |
| 18 | 3 | 3-aminopropyltriethoxysilane | 0.040 | 43.6 | 3.87 |
| 19 | 3 | [3-(N,N-dimethylamino)propyl]trimethoxysilane | 0.012 | 43.2 | 3.85 |
| 20 | 3 | 3-aminopropyltriethoxysilane | 0.088 | 43.7 | 3.95 |
| 21 | 3 | 3-(2-aminoethylamino)propyltriethoxysilane | 0.012 | 41.6 | 3.98 |
| 22 | 3 | [3-(N,N-dimethylamino)propyl]trimethoxysilane | 0.012 | 44.8 | 3.82 |
| 23 | 3 | 3-aminopropyltriethoxysilane | 0.007 | 43.6 | 3.95 |
| 24 | 3 | 3-aminopropyltriethoxysilane | 0.100 | 43.7 | 3.96 |
| 25 | 3 | 3-aminopropyltrimethoxysilane | 0.088 | 41.6 | 3.97 |
| 26 | 3 | 3-aminopropyltriethoxysilane | 0.088 | 45.1 | 3.79 |
| 27 | 4 | 3-aminopropyltriethoxysilane | 0.010 | 55.6 | 4.81 |
| 28 | 4 | 3-aminopropyltrimethoxysilane | 0.010 | 55.7 | 4.80 |
| 29 | 4 | 3-aminopropyltrimethoxysilane | 0.090 | 55.9 | 4.80 |
| 30 | 4 | 3-aminopropyltrimethoxysilane | 0.090 | 55.7 | 4.79 |
| 31 | 4 | 3-aminopropyltrimethoxysilane | 0.090 | 56.2 | 4.75 |
| 32 | 4 | 3-aminopropyltrimethoxysilane | 0.090 | 57.4 | 4.61 |
| 33 | 4 | 3-glycidyloxypropyltrimethoxysilane | 0.090 | 57.1 | 4.63 |

TABLE 6

| magnetic carrier No. | core material No. | coating resin solution No. | content of primer compound in the resin coat layer (mass %) | resistivity at the field strength of 2000 V/cm (Ω · cm) | resin coat layer minimum film thickness (μm) | resin coat layer maximum film thickness (μm) | content of resin coat layer (mass parts) |
|---|---|---|---|---|---|---|---|
| 1 | 1 | 1 | — | $4.6 \times 10^8$ | 2.355 | 2.937 | 2.0 |
| 2 | 2 | 2 | — | $3.8 \times 10^8$ | 2.215 | 2.873 | 2.0 |
| 3 | 3 | 3 | — | $3.9 \times 10^8$ | 2.190 | 2.765 | 2.0 |
| 4 | 4 | 4 | — | $3.5 \times 10^8$ | 2.165 | 2.740 | 2.0 |
| 5 | 5 | 5 | — | $5.2 \times 10^8$ | 2.615 | 3.025 | 2.3 |
| 6 | 6 | 6 | — | $9.1 \times 10^7$ | 1.750 | 2.295 | 1.2 |
| 7 | 7 | 7 | 4.0 | $5.3 \times 10^8$ | 2.790 | 3.410 | 1.8 |
| 8 | 8 | 8 | 2.0 | $1.5 \times 10^8$ | 0.015 | 1.035 | 1.2 |
| 9 | 9 | 9 | — | $5.6 \times 10^9$ | 3.620 | 4.105 | 4.5 |
| 10 | 10 | 10 | — | $3.7 \times 10^8$ | 2.030 | 2.545 | 1.8 |
| 11 | 11 | 11 | — | $7.2 \times 10^8$ | 2.055 | 2.600 | 1.8 |
| 12 | 12 | 12 | — | $2.1 \times 10^7$ | 2.105 | 2.610 | 1.8 |
| 13 | 13 | 13 | — | $2.3 \times 10^7$ | 2.115 | 2.650 | 1.8 |
| 14 | 14 | 14 | — | $3.9 \times 10^8$ | 2.365 | 2.900 | 2.0 |
| 15 | 15 | 15 | — | $3.1 \times 10^8$ | 2.305 | 2.895 | 2.0 |
| 16 | 16 | 16 | — | $1.5 \times 10^7$ | 2.385 | 2.855 | 2.0 |
| 17 | 17 | 17 | — | $1.1 \times 10^7$ | 2.380 | 2.640 | 2.0 |
| 18 | 18 | 18 | — | $1.1 \times 10^7$ | 2.365 | 2.655 | 2.0 |
| 19 | 19 | 19 | — | $1.0 \times 10^7$ | 2.265 | 2.985 | 2.0 |
| 20 | 20 | 20 | 3.7 | $1.9 \times 10^7$ | 2.460 | 3.005 | 2.0 |
| 21 | 21 | 21 | 3.8 | $4.5 \times 10^6$ | 0.010 | 0.025 | 0.7 |
| 22 | 22 | 22 | 4.0 | $4.2 \times 10^7$ | 3.785 | 4.055 | 4.8 |
| 23 | 23 | 23 | — | $1.8 \times 10^7$ | 2.195 | 2.830 | 2.0 |
| 24 | 24 | 24 | 10.0 | $2.2 \times 10^7$ | 2.465 | 3.010 | 2.0 |
| 25 | 25 | 25 | — | $2.4 \times 10^6$ | 0.005 | 0.450 | 0.4 |
| 26 | 26 | 28 | — | $6.8 \times 10^7$ | 3.985 | 4.225 | 5.3 |
| 27 | 27 | 27 | — | $9.5 \times 10^7$ | 1.725 | 2.175 | 1.2 |
| 28 | 28 | 28 | — | $9.7 \times 10^7$ | 1.955 | 2.685 | 1.5 |
| 29 | 29 | 29 | — | $9.8 \times 10^7$ | 1.850 | 2.705 | 1.5 |
| 30 | 30 | 30 | — | $9.7 \times 10^7$ | 1.650 | 2.935 | 1.5 |
| 31 | 31 | 31 | — | $1.5 \times 10^8$ | 2.655 | 3.025 | 2.0 |
| 32 | 32 | 32 | 5.0 | $4.5 \times 10^8$ | 3.105 | 3.865 | 3.0 |
| 33 | 33 | 33 | | $4.9 \times 10^8$ | 3.250 | 3.810 | 3.0 |

[Cyan Toner 1 Production Example]

| | |
|---|---|
| binder resin (polyester with Tg: 58° C., acid value: 15 mg KOH/g, hydroxyl value: 15 mg KOH/g) | 100 mass parts |
| C.I. Pigment Blue 15:3 | 5.5 mass parts |
| aluminum 3,5-di-t-butylsalicylate compound | 0.5 mass parts |
| normal-paraffin wax (melting point: 78° C.) | 6 mass parts |

The aforementioned material formulation was thoroughly mixed in a HENSCHEL MIXER (Model FM-75J, Mitsui Mining Co., Ltd.) and then kneaded (kneaded material temperature at ejection=150° C.) at a feed rate of 10 kg/hr using a twin-screw kneader (product name: Model PCM-30, Ikegai Ironworks Corp.) set to a temperature of 130° C. The obtained kneaded material was cooled and coarsely pulverized using a hammer mill and then finely pulverized at a feed rate of 15 kg/hr using a mechanical pulverizer (product name: T-250, Turbo Kogyo Co., Ltd.). Particles were obtained that had a weight-average particle diameter of 5.5 μm and that contained 55.6 number % particles having a particle diameter of 4.0 μm and less and 0.8 volume % particles with a particle diameter of 10.0 μm and above.

Using a rotary classifier (product name: TTSP100, Hosokawa Micron Corporation), the obtained particles were subjected to classification that cut the fines and coarse particles. A cyan toner particle 1 was obtained that had a weight-average particle diameter of 6.4 μm, a content of particles with a particle diameter of not more than 4.0 μm of 25.8 number %, and a content of particles with a particle diameter of at least 10.0 μm of 2.5 volume %.

In addition, the materials indicated below were introduced into a HENSCHEL MIXER (product name: Model FM-75, Nippon Coke & Engineering Co., Ltd.), and the silica particles and titanium oxide particles were attached to the surface of the cyan toner particle 1 by mixing for a mixing time of 3 minutes using a peripheral velocity for the rotating blades of 35.0 (m/sec), thus providing a cyan toner 1.

cyan toner particle 1:100 mass parts silica particles: 3.5 mass parts (silica particles provided by subjecting silica particles produced by a sol-gel method to a surface treatment with 1.5 mass % hexamethyldisilazane and then adjustment to the desired particle size distribution by classification)

titanium oxide particles: 0.5 mass parts (titanium oxide particles provided by subjecting a metatitanic acid exhibiting anatase crystallinity to surface treatment with an octylsilane compound)

[Synthesis of Crystalline Polyester Resin]

1200 parts of 1,6-hexanediol, 1200 parts of decanedioic acid, and 0.4 parts of dibutyltin oxide as catalyst were introduced into a reaction vessel fitted with a condenser, stirrer, and nitrogen introduction conduit; the air within the vessel was then converted into an inert atmosphere using nitrogen gas and a pressure reduction process; and stirring was carried out for 4 hours at 180 rpm using a mechanical stirrer. After this, the temperature was gradually raised to 210° C. under reduced pressure and stirring was carried out for 1.5 hours; the reaction was stopped by air cooling when a viscous state was reached to obtain a [crystalline polyester resin].

[Cyan Toner 2 Production Example]

| | |
|---|---|
| binder resin (polyester with Tg: 58° C., acid value: 15 mg KOH/g, hydroxyl value: 15 mg KOH/g) | 90 mass parts |
| the aforementioned crystalline polyester resin | 10 mass parts |
| C.I. Pigment Blue 15:3 | 5.5 mass parts |
| aluminum 3,5-di-t-butylsalicylate compound | 0.5 mass parts |
| normal-paraffin wax (melting point: 78° C.) | 6 mass parts |

A cyan toner 2 was obtained proceeding as in the Cyan Toner 1 Production Example, but using the material formulation indicated above.

Examples 1 to 5

Adding 10 mass parts of cyan toner 1 or cyan toner 2 per 90 mass parts of magnetic carrier 1, 300 g of a two-component developer was prepared by shaking in a shaker (Model YS-8D, Yayoi Co., Ltd.). The shaking conditions with the shaker were 200 rpm and 2 minutes.

The following evaluations were carried out using this two-component developer.

The image-forming apparatus used was a modified color copier (product name: imageRUNNER ADVANCE C9075 PRO) from Canon, Inc.

The two-component developer was introduced into the developing device for each color; the replenishing developer container filled with replenishing developer was installed; and image formation was carried out and the various evaluations were performed.

The environmental evaluations with the copier were carried out at a temperature of 23° C./humidity of 50% RH (N/N in the following), a temperature of 23° C./humidity of 5% RH (N/L in the following), and a temperature of 30° C./humidity of 80% RH (H/H in the following).

The type of output image and the number of prints output varied according to the particular item being evaluated.

Conditions:

paper: laser printer paper (product name: CS-814 (81.4 g/m$^2$), Canon Marketing Japan Inc.);

image formation speed: modified to enable output at 80 prints/minute in full color of A4 paper;

developing conditions: modifications were made to enable adjustment of the developing contrast to any value and to prevent the operation of automatic correction by the main unit.

Only toner filled in the replenishing developer container was used for the replenishing developer.

The individual evaluated items are given below.

(1) Density Difference Between Individual Environments (Evaluations V and W)

The evaluations were carried out using cyan toner 1.

Operating under "N/N", 1,000 prints of a solid cyan image were output with the developing contrast adjusted such that the solid image reflection density on the paper for each single color was 1.50. After this, with the same developing contrast as set for N/N, 10 prints of a solid cyan image were output in each particular environment after the main unit of the copier had been held for 24 hours in each of the following environments: the N/L environment and the H/H environment.

In the measurements, the reflection density was measured at 5 randomly selected points on the 1st, 5th, and 10th images of the 10 output images, and the average value of this was calculated. A 500 Series spectral densitometer (X-Rite, Incorporated) was used for the reflection density.

With regard to the evaluations, evaluation V concerned the absolute value of the reflection density difference for H/H versus N/N, while evaluation W concerned the absolute value of the reflection density difference for N/L versus N/N.

The evaluation criteria for evaluations V and W are as follows.

A (10 points): less than 0.06
B (8 points): at least 0.06 and less than 0.10
C (6 points): at least 0.10 and less than 0.14
D (4 points): at least 0.14 and less than 0.18
E (2 points): at least 0.18

(2) Halftone Density Reproducibility (Evaluation X)

The evaluations were carried out using cyan toner 1.

An image in which individual patterns in the initial set-up were set to the densities given below, was output immediately after the feed of 5,000 sheets of paper in the N/L environment, and the deviation in gradation between initial and immediately after the feed of 5,000 sheets of paper was checked. The images were assessed based on measurement of the respective image densities using an X-Rite color reflection densitometer (X-Rite 404A color reflection densitometer). The evaluation was carried out using cyan single color (evaluation X).

pattern 1: 0.10 to 0.13
pattern 2: 0.25 to 0.28
pattern 3: 0.45 to 0.48
pattern 4: 0.65 to 0.68
pattern 5: 0.85 to 0.88
pattern 6: 1.05 to 1.08
pattern 7: 1.25 to 1.28
pattern 8: 1.45 to 1.48

The evaluation criteria are as follows.

A (5 points): all of the pattern images satisfy the density ranges given above
B (4 points): one of the pattern images is out of the density ranges given above
C (3 points): two of the pattern images are out of the density ranges given above
D (2 points): three of the pattern images are out of the density ranges given above
E (1 point): four or more of the pattern images are out of the density ranges given above (3) Image Density Difference Pre-Versus-Post-Standing in a High-Temperature, High-Humidity Environment (Evaluations Y and Z)

The evaluations were carried out using cyan toner 2.

After a humidity conditioning for 72 hours in the H/H environment, 5,000 prints of a solid image were output with the developing contrast adjusted such that the solid image reflection density was 1.50. This was followed by standing under the same conditions, and, after 9 days, a single print of a solid image was output. The image density was measured using a 500 series spectral densitometer (X-Rite, Incorporated), and the density difference pre-versus-post-standing (image density before standing−image density after standing) was evaluated (evaluation Y).

After this, a process of continuously outputting 9 solid white image prints and 1 solid image print was repeated. The evaluation (evaluation Z) was performed during these processes by measuring the number of processes required for the reflection density on the one solid image to become 1.50±0.02.

The evaluation criteria for evaluation Y are as follows.

A (10 points) less than 0.06
B (8 points) at least 0.06 and less than 0.10
C (6 points) at least 0.10 and less than 0.14
D (4 points) at least 0.14 and less than 0.18
E (2 points): at least 0.18

The evaluation criteria for evaluation Z are as follows.

A (5 points): at least 1 process and not more than 2 processes
B (4 points): at least 3 processes and not more than 5 processes
C (3 points): at least 6 processes and not more than 8 processes
D (2 points): at least 9 processes and not more than 12 processes
E (1 point): 13 or more processes (4) Overall Score The evaluation rankings in evaluations V to Z were converted into numerical values and the total value was scored on the following scale.

A: at least 38 and not more than 40
B: at least 31 and not more than 37
C: at least 23 and not more than 30
D: at least 19 and not more than 22
E: 18 or less The results were very good in all of the evaluations in Examples 1 to 5. The results of the evaluations are given in Tables 7 and 8.

Examples 1 to 22 used magnetic carriers 1 to 22, respectively, and Comparative Examples 1 to 11 used magnetic carriers 23 to 33, respectively.

Example 6

Example 6 is an example in which the core material particle has a large true density and a charge increase in N/L is facilitated and the appearance of some influence on the environmental stability and the halftone density reproducibility is then facilitated. The results of the evaluations are given in Tables 7 and 8.

Example 7

Example 7 is an example in which a small amount of the amino group-bearing primer compound is present in the resin coat layer, and the appearance of some influence on the environmental stability and the image density difference pre-versus-post-standing is then facilitated due to a charge increase in N/L. The results of the evaluations are given in Tables 7 and 8.

Examples 8 and 9

Example 8 is an example in which the film thickness of the coat layer is somewhat thin and some influence appeared on the environmental stability and image density difference pre-versus-post-standing due to a charge increase in N/L. Example 9 is an example in which the film thickness of the coat layer is somewhat thick, and the effect of the amino group-containing primer compound undergoes a decline and the appearance of some influence on the image density difference pre-versus-post-standing is facilitated. The results of the evaluations are given in Tables 7 and 8.

Examples 10 to 13

The amount of the primer compound is varied in Examples 10 to 13. When the amount of the primer compound is smaller, the charge declines in H/H and when it is larger the charge increases in N/L, and the appearance of an influence on the environmental stability is thus facilitated.

The appearance of some influence on the image density difference pre-versus-post-standing is also facilitated. The results of the evaluations are given in Tables 7 and 8.

Examples 14 to 18

The resin in the resin coat layer is varied in Examples 14 to 18. The improvement in the environmental stability and the effect of reducing the image density difference pre-versus-post-standing can be increased by using a macromonomer in the resin. In addition, when two kinds of coating resins are used, there is also an effect on the density stability during durability testing due to providing a suitable acid value range. The results of the evaluations are given in Tables 7 and 8.

Example 19

Example 19 is an example that uses a small addition of the primer compound. The appearance of an influence on the environmental stability is facilitated due to a charge reduction in H/H. In addition, the appearance of an influence on the image density difference pre-versus-post-standing is facilitated. The results of the evaluations are given in Tables 7 and 8.

Example 20

Example 20 is an example that uses a large addition of the primer compound. The appearance of an influence on the environmental stability is facilitated due to a charge increase in N/L. In addition, the appearance of an influence on the image density difference pre-versus-post-standing is facilitated. The results of the evaluations are given in Tables 7 and 8.

Example 21

Example 21 is an example that uses a small amount of the resin coat, and an influence on the environmental stability and image density difference pre-versus-post-standing then appears at both N/L and H/H. The results of the evaluations are given in Tables 7 and 8.

Example 22

Example 22 is an example that uses a large amount of the resin coat, and obtaining the effects of the primer compound is then impeded and the appearance of an influence on the image density difference pre-versus-post-standing is facilitated. The results of the evaluations are given in Tables 7 and 8.

Comparative Example 1

Comparative Example 1 is an example in which the amount of primer treatment is too small, and the effect of the primer compound is then not obtained and an influence then appears on the environmental stability and image density difference pre-versus-post-standing. The results of the evaluations are given in Tables 7 and 8.

Comparative Example 2

Comparative Example 2 is an example in which the amount of primer treatment is too large, and the environmental stability is then reduced due to the provision of excessive charge by the primer compound. In addition, the image density difference pre-versus-post-standing also assumes a increasing trend. The results of the evaluations are given in Tables 7 and 8.

Comparative Example 3

Comparative Example 3 is an example in which the amount of the coat resin is too small, and an influence then appears on the environmental stability and image density difference pre-versus-post-standing due to an increase in charge in N/L. The results of the evaluations are given in Tables 7 and 8.

Comparative Example 4

Comparative Example 4 is an example that uses a large amount of the resin coating, and obtaining the effect of the primer compound was then impeded and the image density difference pre-versus-post-standing was increased. The results of the evaluations are given in Tables 7 and 8.

Comparative Examples 5 to 10

Comparative Examples 5 to 10 are examples that used a coating resin that did not have an alicyclic hydrocarbon group, and in each case the surface smoothing activity characteristic of the alicyclic hydrocarbon group was not obtained and the density stability and halftone density reproducibility were reduced. In addition, an influence then appears on the environmental stability and image density difference pre-versus-post-standing. The results of the evaluations are given in Tables 7 and 8.

Comparative Example 11

Comparative Example 11 is an example that used a primer compound that did not have an amino group. The effects of the present invention were not exhibited and an influence then appears on the environmental stability and image density difference pre-versus-post-standing. The results of the evaluations are given in Tables 7 and 8.

TABLE 7

| | evaluation V (N/N − H/H) | | | evaluation W (N/N − N/L) | | | evaluation X | | | evaluation Y | | | evaluation Z | |
|---|---|---|---|---|---|---|---|---|---|---|---|---|---|---|
| | H/H reflection density (%) | difference from N/N (%) | evaluation | N/L reflection density (%) | difference from N/N (%) | evaluation | out-of-range pattern numbers | number out of range (number) | evaluation | reflection density (%) | difference from before standing (%) | evaluation | number of times required for recovery (times) | evaluation |
| Example 1 | 1.52 | 0.02 | A | 1.47 | 0.03 | A | — | 0 | A | 1.53 | 0.03 | A | 1 | A |
| Example 2 | 1.53 | 0.03 | A | 1.47 | 0.03 | A | — | 0 | A | 1.53 | 0.03 | A | 1 | A |
| Example 3 | 1.54 | 0.04 | A | 1.46 | 0.04 | A | — | 0 | A | 1.54 | 0.04 | A | 1 | A |
| Example 4 | 1.54 | 0.04 | A | 1.46 | 0.04 | A | — | 0 | A | 1.55 | 0.05 | A | 2 | A |
| Example 5 | 1.54 | 0.04 | A | 1.45 | 0.05 | A | — | 0 | A | 1.55 | 0.05 | A | 2 | A |
| Example 6 | 1.55 | 0.05 | A | 1.44 | 0.06 | B | 6 | 1 | B | 1.55 | 0.05 | A | 2 | A |
| Example 7 | 1.55 | 0.05 | A | 1.43 | 0.07 | B | 2 | 1 | B | 1.55 | 0.05 | A | 2 | A |
| Example 8 | 1.55 | 0.05 | A | 1.44 | 0.06 | B | — | 0 | A | 1.57 | 0.07 | B | 2 | A |
| Example 9 | 1.54 | 0.04 | A | 1.43 | 0.07 | B | — | 0 | A | 1.58 | 0.08 | B | 3 | B |
| Example 10 | 1.56 | 0.06 | B | 1.45 | 0.05 | A | 6 | 1 | B | 1.57 | 0.07 | B | 4 | B |
| Example 11 | 1.55 | 0.05 | A | 1.43 | 0.07 | B | 5 | 1 | B | 1.59 | 0.09 | B | 4 | B |
| Example 12 | 1.54 | 0.04 | A | 1.40 | 0.10 | C | 4 | 1 | B | 1.59 | 0.09 | B | 4 | B |
| Example 13 | 1.55 | 0.05 | A | 1.39 | 0.11 | C | 4, 6 | 2 | C | 1.59 | 0.09 | B | 5 | B |
| Example 14 | 1.57 | 0.07 | B | 1.43 | 0.07 | B | 2, 3 | 2 | C | 1.59 | 0.09 | B | 6 | C |
| Example 15 | 1.57 | 0.07 | B | 1.41 | 0.09 | B | 2, 3 | 2 | C | 1.58 | 0.08 | B | 7 | C |
| Example 16 | 1.58 | 0.08 | B | 1.42 | 0.08 | B | 5, 6 | 2 | C | 1.61 | 0.11 | C | 6 | C |
| Example 17 | 1.60 | 0.10 | C | 1.41 | 0.09 | B | 2, 4 | 2 | C | 1.60 | 0.10 | C | 7 | C |
| Example 18 | 1.62 | 0.12 | C | 1.41 | 0.09 | B | 3, 5 | 2 | C | 1.61 | 0.11 | C | 8 | C |
| Example 19 | 1.64 | 0.14 | D | 1.38 | 0.12 | C | 2, 7 | 2 | C | 1.63 | 0.13 | C | 8 | C |
| Example 20 | 1.63 | 0.13 | C | 1.36 | 0.14 | D | 3, 4 | 2 | C | 1.62 | 0.12 | C | 8 | C |
| Example 21 | 1.65 | 0.15 | D | 1.35 | 0.15 | D | 2, 6 | 2 | C | 1.63 | 0.13 | C | 8 | C |
| Example 22 | 1.65 | 0.15 | D | 1.35 | 0.15 | D | 2, 3 | 2 | C | 1.63 | 0.13 | C | 8 | C |
| Comparative Example 1 | 1.68 | 0.18 | E | 1.34 | 0.16 | D | 3, 6 | 2 | C | 1.64 | 0.14 | D | 8 | C |
| Comparative | 1.66 | 0.16 | D | 1.32 | 0.18 | E | 2, 5, 7 | 3 | D | 1.65 | 0.15 | D | 8 | C |

TABLE 7-continued

| | evaluation V (N/N − H/H) | | | evaluation W (N/N − N/L) | | | evaluation X | | | evaluation Y | | | evaluation Z | |
|---|---|---|---|---|---|---|---|---|---|---|---|---|---|---|
| | H/H reflection density (%) | difference from N/N (%) | evaluation | N/L reflection density (%) | difference from N/N (%) | evaluation | out-of-range pattern numbers | number out of range (number) | evaluation | reflection density (%) | difference from before standing (%) | evaluation | number of times required for recovery (times) | evaluation |
| Example 2 | | | | | | | | | | | | | | |
| Comparative Example 3 | 1.67 | 0.17 | D | 1.32 | 0.18 | E | 2, 4, 6 | 3 | D | 1.65 | 0.15 | D | 9 | D |
| Comparative Example 4 | 1.68 | 0.18 | E | 1.34 | 0.16 | D | 2, 3, 4 | 3 | D | 1.65 | 0.15 | D | 10 | D |
| Comparative Example 5 | 1.69 | 0.19 | E | 1.35 | 0.15 | D | 6, 7, 8 | 3 | D | 1.67 | 0.17 | D | 11 | D |
| Comparative Example 6 | 1.69 | 0.19 | E | 1.35 | 0.15 | D | 5, 6, 7 | 3 | D | 1.67 | 0.17 | D | 11 | D |
| Comparative Example 7 | 1.69 | 0.19 | E | 1.35 | 0.15 | D | 2, 4, 7 | 3 | D | 1.69 | 0.19 | E | 12 | D |
| Comparative Example 8 | 1.68 | 0.18 | E | 1.34 | 0.16 | D | 3, 4, 6 | 3 | D | 1.68 | 0.18 | E | 13 | C |
| Comparative Example 9 | 1.69 | 0.19 | E | 1.34 | 0.16 | D | 3, 4, 6 | 3 | D | 1.69 | 0.19 | E | 14 | E |
| Comparative Example 10 | 1.68 | 0.18 | E | 1.34 | 0.16 | D | 2, 4 | 2 | C | 1.70 | 0.20 | E | 12 | D |
| Comparative Example 11 | 1.70 | 0.20 | E | 1.35 | 0.15 | D | 3, 4, 7 | 3 | D | 1.72 | 0.22 | E | 13 | E |

TABLE 8

| | evaluation V | evaluation W | evaluation X | evaluation Y | evaluation Z | evaluation score | overall evaluation |
|---|---|---|---|---|---|---|---|
| Example 1 | 10 | 10 | 5 | 10 | 5 | 40 | A |
| Example 2 | 10 | 10 | 5 | 10 | 5 | 40 | A |
| Example 3 | 10 | 10 | 5 | 10 | 5 | 40 | A |
| Example 4 | 10 | 10 | 5 | 10 | 5 | 40 | A |
| Example 5 | 10 | 10 | 5 | 10 | 5 | 40 | A |
| Example 6 | 10 | 8 | 4 | 10 | 5 | 37 | B |
| Example 7 | 10 | 8 | 4 | 10 | 5 | 37 | B |
| Example 8 | 10 | 8 | 5 | 8 | 5 | 36 | B |
| Example 9 | 10 | 8 | 5 | 8 | 4 | 35 | B |
| Example 10 | 8 | 10 | 4 | 8 | 4 | 34 | B |
| Example 11 | 10 | 8 | 4 | 8 | 4 | 34 | B |
| Example 12 | 10 | 6 | 4 | 8 | 4 | 32 | B |
| Example 13 | 10 | 6 | 3 | 8 | 4 | 31 | B |
| Example 14 | 8 | 8 | 3 | 8 | 3 | 30 | C |
| Example 15 | 8 | 8 | 3 | 8 | 3 | 30 | C |
| Example 16 | 8 | 8 | 3 | 8 | 3 | 28 | C |
| Example 17 | 6 | 8 | 3 | 6 | 3 | 26 | C |
| Example 18 | 6 | 8 | 3 | 6 | 3 | 26 | C |
| Example 19 | 4 | 6 | 3 | 6 | 3 | 22 | D |
| Example 20 | 6 | 4 | 3 | 6 | 3 | 22 | D |
| Example 21 | 4 | 4 | 3 | 6 | 3 | 20 | D |
| Example 22 | 4 | 4 | 3 | 6 | 3 | 20 | D |
| Comparative Example 1 | 2 | 4 | 3 | 4 | 3 | 16 | E |
| Comparative Example 2 | 4 | 2 | 2 | 4 | 3 | 15 | E |
| Comparative Example 3 | 4 | 2 | 2 | 4 | 2 | 14 | E |
| Comparative Example 4 | 2 | 4 | 2 | 4 | 2 | 14 | E |
| Comparative Example 5 | 2 | 4 | 2 | 4 | 2 | 14 | E |
| Comparative Example 6 | 2 | 4 | 2 | 4 | 2 | 14 | E |
| Comparative Example 7 | 2 | 4 | 2 | 2 | 2 | 12 | E |
| Comparative Example 8 | 2 | 4 | 2 | 2 | 1 | 11 | E |
| Comparative Example 9 | 2 | 4 | 2 | 2 | 1 | 11 | E |
| Comparative Example 10 | 2 | 4 | 3 | 2 | 2 | 13 | E |
| Comparative Example 11 | 2 | 4 | 2 | 2 | 1 | 11 | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-022014, filed Feb. 8, 2016, which is hereby incorporated by reference herein in its entirety.

What is claimed is:

1. A magnetic carrier comprising a magnetic carrier particle comprising a magnetic ferrite core material particle, an intermediate layer on the ferrite core material particle, and a resin coat layer on the intermediate layer, wherein the intermediate layer comprises an amino group-bearing compound;

the resin coat layer comprises (i) a coating resin A that is a polymer of monomer comprising a (meth)acrylate ester having an alicyclic hydrocarbon group and that has an acid value of 0.0 to 3.0 mg KOH/g, and (ii) a coating resin B that is a polymer of monomer comprising (meth)acrylic acid and that has an acid value of 3.5 to 50.0 mg KOH/g;

the content of the amino group-bearing compound in the intermediate layer is 0.010 to 0.090 mass parts per 100 mass parts of the ferrite core material particle; and the content of the resin coat layer in the magnetic carrier particle is 0.5 to 5.0 mass parts per 100 mass parts of the total mass of the ferrite core material particle and the intermediate layer.

2. The magnetic carrier according to claim 1, wherein the coating resin A comprises a copolymer of monomer comprising a macromonomer and a (meth)acrylate ester having an alicyclic hydrocarbon group; and the macromonomer is a polymer of one or more monomers selected from the group consisting of methyl acrylate, methyl methacrylate, butyl acrylate, butyl methacrylate, 2-ethylhexyl acrylate, 2-ethylhexyl methacrylate, styrene, acrylonitrile, and methacrylonitrile.

3. The magnetic carrier according to claim 1, wherein the content of the amino group-bearing compound in the intermediate layer is 0.010 to 0.080 mass parts per 100 mass parts of the ferrite core material particle.

4. The magnetic carrier according to claim 1, wherein the content of the amino group-bearing compound in the intermediate layer is 0.010 to 0.060 mass parts per 100 mass parts of the ferrite core material particle.

5. The magnetic carrier according to claim 1, wherein the content of the amino group-bearing compound in the intermediate layer is 0.020 to 0.080 mass parts per 100 mass parts of the ferrite core material particle.

6. The magnetic carrier according to claim 1, wherein the minimum film thickness of the resin coat layer is 0.010 to 4.000 μm.

7. The magnetic carrier according to claim 1, wherein the resin coat layer comprises the amino group-bearing compound, and the content of the amino group-bearing compound in the resin coat layer is not more than 4.0 mass %.

8. The magnetic carrier according to claim 1, wherein the ferrite core material particle is a particle comprising a porous particle having pores, and a resin filled into the pores.

9. A two-component developer comprising a magnetic carrier and a toner having a toner particle comprising a binder resin, wherein the magnetic carrier is the magnetic carrier according to claim 1.

10. The two-component developer according to claim 9, wherein the toner particle comprises a crystalline polyester.

11. A replenishing developer for use in an image-forming method comprising:

a charging step of charging an electrostatic latent image-bearing member;

an electrostatic latent image-forming step of forming an electrostatic latent image on a surface of the electrostatic latent image-bearing member;

a developing step of forming a toner image by developing the electrostatic latent image using a two-component developer within a developing device;

a transfer step of transferring the toner image, via an intermediate transfer member or without an intermediate transfer member, to a transfer material; and a fixing step of fixing the transferred toner image to the transfer material, wherein the replenishing developer is supplied to the developing device in correspondence to a decline in the toner concentration of the two-component developer within the developing device, the replenishing developer comprises a magnetic carrier and a toner having a toner particle comprising a binder resin, the replenishing developer contains 2 to 50 mass parts of the toner per 1 mass parts of the magnetic carrier, and the magnetic carrier is the magnetic carrier according to claim 1.

* * * * *